US007890034B2

(12) United States Patent
Murayama et al.

(10) Patent No.: US 7,890,034 B2
(45) Date of Patent: Feb. 15, 2011

(54) IMAGE FORMING APPARATUS

(75) Inventors: Tatsuomi Murayama, Toride (JP); Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/822,463

(22) Filed: Jun. 24, 2010

(65) Prior Publication Data

US 2010/0260521 A1 Oct. 14, 2010

Related U.S. Application Data

(62) Division of application No. 11/484,562, filed on Jul. 12, 2006, now Pat. No. 7,769,328.

(30) Foreign Application Priority Data

Jul. 29, 2005 (JP) ..... 2005-222282

(51) Int. Cl.
*G03G 15/01* (2006.01)

(52) U.S. Cl. ..... 399/299; 399/303; 399/313; 399/341

(58) Field of Classification Search ..... 399/299, 399/302, 308, 341, 313, 303–305
See application file for complete search history.

(56) References Cited

U.S. PATENT DOCUMENTS 6,850,726 B1 * 2/2005 Mizuno et al. ..... 399/299
2005/0063739 A1 * 3/2005 Kobayashi et al. ..... 399/299
2006/0127134 A1 * 6/2006 Sakamaki et al.
2006/0204288 A1 * 9/2006 Yokoi ..... 399/299
2007/0048021 A1 3/2007 Hirobe et al.
2007/0059050 A1 * 3/2007 Ishida ..... 399/299

FOREIGN PATENT DOCUMENTS

JP 5-6033 A 1/1993
JP 5-127437 A 5/1993
JP 2001-109208 A 4/2001
JP 2002-214871 A 7/2002

* cited by examiner

*Primary Examiner*—David M Gray
*Assistant Examiner*—Laura K Roth
(74) *Attorney, Agent, or Firm*—Fitzpatrick, Cella, Harper & Scinto

(57) ABSTRACT

Provided is an image forming apparatus, including: a first image bearing member; a first transfer member that comes into contact with the intermediate transfer member; a colored toner image forming portion; a second image bearing member; a second transfer member; and a transparent toner image forming portion for forming the transparent toner image wherein the transparent toner image forming portion is provided on an upstream side with respect to the colored toner image forming portion in a movement direction of the intermediate transfer member, and a distance between a most upstream end of the second contact area and the second transfer member in a rotation direction is larger than a distance between a most upstream end of the first contact area and the first transfer member in a rotation direction.

12 Claims, 13 Drawing Sheets

IMAGE FORMING APPARATUS

This application is a divisional of U.S. patent application Ser. No. 11/484,562, filed Jul. 12, 2006.

BACKGROUND OF THE INVENTION

1. Field of the Invention

The present invention relates to an image forming apparatus using colored toner and transparent toner. In particular, the present invention relates to an image forming apparatus capable of concurrently reducing an occurrence of "scattering" and "re-transfer" when a toner image on an image bearing member is transferred onto a recording material to be borne on an intermediate transfer member or a recording material bearing member.

2. Description of the Related Art

Conventionally, as an image forming apparatus using an electrophotographic process, a copying machine, a printer (e.g., a laser beam printer, an LED printer, etc.), a facsimile machine, a word processor, and the like have been widely used. In the image forming apparatus of the electrophotographic process, an electrostatic image (latent image) is formed on an image bearing member that is an electrophotographic photosensitive member (photosensitive drum) generally having a cylindrical shape, the electrostatic image is developed with toner to form a toner image, and the toner image is finally transferred onto a recording material and fixed thereon, whereby an image is output.

Recently, even in the image forming apparatus of the electrophotographic process, there is an increasing demand for an apparatus capable of forming a color image on the recording material by superimposing a plurality of kinds of toner images.

Herein, conventionally, the color image forming apparatus of the electrophotographic process, for forming the color image on the recording material by superimposing the plurality of kinds of toner images, employs the following systems. There is a system (direct transfer system) in which first toner images successively formed on the image bearing member are transferred onto the recording material borne on the recording material bearing member serving as an image transfer member in a transfer portion every time the toner image is formed, and the plurality of kinds of toner images are superimposed on the recording material. Further, there is a system (intermediate transfer system) in which the toner images successively formed on the image bearing member are transferred onto the intermediate transfer member serving as the image transport member in a primary transfer portion every time the toner image is formed, the plurality of kinds of toner images are superimposed on the intermediate transfer member, and then, a multi-layered toner image is secondarily transferred onto the recording material at once. Still further, as the image forming apparatus using the plurality of kinds of toners, so-called tandem-type and rotary-type are widely known.

In the tandem-type image forming apparatus, developing devices filled with developers having different spectral characteristics are provided so as to correspond to the plurality of image bearing members. Image forming portions including the image bearing members and the developers, respectively, are placed in series in a movement direction of the image transport member (recording material bearing member, intermediate transfer member).

On the other hand, in the rotary-type image forming apparatus, a plurality of developing devices are provided so as to correspond to one image bearing member. The plurality of developing devices are provided to a rotatable rotary portion serving as developing device holding means. Then, by rotating the rotary portion, development is performed while the developing devices used are switched. For example, in the case of adopting an intermediate transfer system, the toner image is primarily transferred onto the intermediate transfer member every time the toner image is formed on the image bearing member by each developing device, whereby the multi-layered toner image is formed on the intermediate transfer member. After all the kinds of toner images have been transferred, the toner image on the intermediate transfer member is secondarily transferred onto the recording material.

As a method of transferring the toner image from the image bearing member to a member on which the image is transferred, there has been widely adopted a method of transferring toner from the image bearing member to the member on which the image is transferred electrostatically by applying a bias having a polarity opposite to a charging polarity of the toner from a back surface of the member on which the image is transferred in the transfer portion between the image bearing member and the member on which the image is transferred.

However, in the above-mentioned image forming apparatus in which the toner images are superimposed, when the toner image is transferred onto a recording material or an intermediate transfer member, there arises a problem in that "toner scattering" and "re-transfer" occur, thereby making it impossible to obtain an image of high quality. In this case, the "toner scattering" and the "re-transfer" have an antinomic relationship, so it is difficult to suppress both of them concurrently.

Hereinafter, mechanisms of the occurrence of "toner scattering" and "re-transfer" will be described.

First, the occurrence mechanism of toner scattering phenomenon will be described.

FIG. 13 schematically shows the vicinity of a primary transfer portion N1 of an image forming apparatus adopting the intermediate transfer system. In the primary transfer portion N1 shown in FIG. 13, a primary transfer roller 5 serving as the primary transfer means is opposed to a photosensitive drum 1 serving as the image bearing member via an intermediate transferring belt 21 serving as the intermediate transfer member. The primary transfer roller 5 presses the intermediate transferring belt 21 toward the photosensitive drum 1, whereby the intermediate transferring belt 21 is brought into contact with the photosensitive drum 1. An arrow E of FIG. 13 represents a transport direction (surface movement direction) of the intermediate transferring belt 21. In the primary transfer portion N1 shown in FIG. 13, areas A, B, and C have the following meanings.

The area A (contact area) represents a width of a contact nip (first contact nip) n1 formed between the photosensitive drum 1 and the intermediate transferring belt 21, along the movement direction of the intermediate transferring belt 21.

The area B represents a width of a contact nip (second contact nip) n2 formed between the intermediate transferring belt 21 and the primary transfer roller 5, along the movement direction of the intermediate transferring belt 21.

The area C represents a width of a portion (hereinafter, referred to as "upstream-side gap nip") that extends off an upstream side along the movement direction of the intermediate transferring belt 21 relatively with respect to the first contact nip n1 in the second contact nip n2.

In the following description, the surface (first surface) with respect to an image transport member (intermediate transfer member, recording material bearing member) refers to a surface on a side in contact with the image bearing member, and the back surface (second surface) refers to a surface on an opposite side thereof.

The transfer of the toner image formed on the photosensitive drum 1 to the intermediate transferring belt 21 is usually performed in the area A where the first contact nip n1 and the second contact nip n2 are overlapped on the intermediate transferring belt 21.

However, in the case where the upstream side gap nip area C is present, transfer also occurs in the gap nip area C. That is, in the upstream side gap nip area C, the photosensitive drum 1 and the intermediate transferring belt 21 are opposed to each other with a gap interposed therebetween without forming a contact nip. Therefore, there occurs so-called "pre-transfer" in which a toner image on the photosensitive drum 1 scatters in an air layer to be transferred onto the intermediate transferring belt 21. Pre-transfer causes the toner scattering in an end of a toner image, which degrades image quality.

In order to avoid pre-transfer, it is effective to offset a center (i.e., the center of the area B) B0 in the movement direction of the intermediate transferring belt 21 of the second contact nip n2 formed between the intermediate transferring belt 21 and the primary transfer roller 5, to a downstream side in the movement direction of the intermediate transferring belt 21 relatively with respect to a center (i.e., the center of the area A) A0 in the movement direction of the intermediate transferring belt 21 of the first contact nip n1 formed between the photosensitive drum 1 and the intermediate transferring belt 21. That is, in order to avoid pre-transfer, it is effective to increase a distance L1 of the primary transfer roller 5 from an upstream end A1 of the area A in the rotation direction of the photosensitive drum 1.

Assuming that a vertical line from the rotation shaft of the photosensitive drum 1 to the surface of the intermediate transferring belt 21 is a photosensitive drum center line X, the photosensitive drum center line X typically substantially matches with the center $A_0$ of the area A. Further, assuming that a vertical line from the rotation shaft of the primary transfer roller 5 to the surface of the intermediate transferring belt 21 is a transfer roller center line Y, the transfer roller center line Y substantially matches with the center $B_0$ of the area B. Thus, in this case, as shown in FIG. 14, the rotation shaft of the primary transfer roller 5 is placed so as to be shifted to a downstream side in the movement direction (direction represented by the arrow E) of the intermediate transferring belt 21, with respect to the rotation shaft of the photosensitive drum 1 by a distance L (mm) between the photosensitive drum center line X and the transfer roller center line Y.

With such a configuration, the upstream side gap nip area C can be reduced as much as possible. This can suppress the pre-transfer, thereby preventing a phenomenon of toner scattering.

Next, the occurrence mechanism of the re-transfer will be described.

The following was found: when the rotation shaft of the primary transfer roller 5 is placed so as to be offset to the downstream side in the movement direction of the intermediate transferring belt 21 with respect to the rotation shaft of the photosensitive drum 1 in order to prevent pre-transfer, a phenomenon (hereinafter, referred to as "re-transfer") becomes more conspicuous in which a toner image having been transferred onto the intermediate transferring belt 21 by the previous primary transfer operations is reversely transferred from the intermediate transferring belt 21 to the photosensitive drum 1 during a subsequent primary transfer operation.

That is, in the rotation direction of the photosensitive drum 1, by increasing the distance from the upstream end A1 of the area A to the primary transfer roller 5, "re-transfer" becomes more conspicuous.

In FIG. 15, in a case where a yellow toner image is transferred onto the intermediate transferring belt 21 by the first primary transfer operation, and a magenta toner image is transferred onto the intermediate transferring belt 21 by the second primary transfer operation, the above-mentioned distance L in the primary transfer portion of the magenta toner image is varied. FIG. 15 shows results of a relationship between the re-transfer amount of the toner transferred onto the intermediate transferring belt 21 in the primary transfer portion of the yellow toner image and the transfer current.

An amount of toner (re-transfer toner amount) to be re-transferred is measured as follows. That is, a predetermined image is formed on the intermediate transferring belt 21 by the first primary transfer operation. Then, while the second primary transfer operation is being performed, the power supply of the main body of the image forming apparatus is turned off, whereby toner transferred onto the surface of the photosensitive drum 1 at this time is transferred onto an adhesive tape. A density of the toner obtained by allowing the adhesive tape to adhere to a white recording sheet and subtracting a reflecting density of a sample tape from the reflectance of a reference tape is determined to be a re-transfer toner amount.

As is understood from FIG. 15, when the rotation shaft of the primary transfer roller 5 is offset to the downstream side of the intermediate transferring belt 21 with respect to the rotation shaft of the photosensitive drum 1 so as to eliminate the upstream side gap nip area C, in order to prevent the pre-transfer, the amount of re-transfer toner increases.

Re-transfer is considered to occur as follows: among the toner transferred onto the intermediate transferring belt 21, toner having a small charged amount and toner reversely charged due to an influence of a discharge phenomenon in a transfer portion or a transfer current are transferred onto the photosensitive drum 1 side. When re-transfer occurs, the density of a final image may become low depending upon the degree of re-transfer.

As described above, suppressing pre-transfer to prevent a toner scattering phenomenon and reducing the amount of re-transfer toner have an antinomic relationship, and it is difficult to reduce the occurrence of "toner scattering" and "re-transfer" concurrently.

SUMMARY OF THE INVENTION

It is an object of the present invention to reduce occurrences of "toner scattering" and "re-transfer" at the same time in an image forming apparatus using transparent toner.

Further, it is another object of the present invention to provide an image forming apparatus including the following.

There is provided an image forming apparatus, including: a first image bearing member that comes into contact with an intermediate transfer member in a first contact area, and rotates while bearing a colored toner image; a first transfer member that comes into contact with the intermediate transfer member, for electrostatically transferring the colored toner image to the intermediate transfer member; a colored toner image forming portion for forming the colored toner image on the intermediate transfer member; a second image bearing member that comes into contact with the intermediate transfer member in a second contact area, and rotates while bearing a transparent toner image; a second transfer member that comes into contact with the intermediate transfer member, for electrostatically transferring the transparent toner image to the intermediate transfer member; and a transparent toner image forming portion for forming the transparent toner image on the intermediate transfer member so that the transparent toner image comes into contact with at least a part of the colored toner image on the intermediate transfer member.

In the image forming apparatus, the transparent toner image forming portion is provided on an upstream side with respect to the colored toner image forming portion in a movement direction of the intermediate transfer member, and a distance between a most upstream end of the second contact area and the second transfer member in a rotation direction of the second image bearing member is larger than a distance between a most upstream end of the first contact area and the first transfer member in a rotation direction of the first image bearing member.

Further, it is still another object of the present invention to provide an image forming apparatus including the following.

There is provided an image forming apparatus, including: a first image bearing member that comes into contact with a recording material bearing member in a first contact area, and rotates while bearing a colored toner image; a first transfer member that comes into contact with the recording material bearing member, for electrostatically transferring the colored toner image to a recording material borne on the recording material bearing member; a colored toner image forming portion for forming the colored toner image on the recording material; a second image bearing member that comes into contact with the recording material bearing member in a second contact area, and rotates while bearing a transparent toner image; and a second transfer member that comes into contact with the recording material bearing member, for electrostatically transferring the transparent toner image to the recording material borne on the recording material bearing member; and a transparent toner image forming portion for forming the transparent toner image on the intermediate transfer member so that the transparent toner image comes into contact with at least a part of the colored toner image on the recording material.

In the image forming apparatus, the transparent toner image forming portion is provided on an upstream side with respect to the colored toner image forming portion in a moving direction of the recording material bearing member, and a distance between a most upstream end of the second contact area and the second transfer member in a rotation direction of the second image bearing member is larger than a distance between a most upstream end of the first contact area and the first transfer member in a rotation direction of the first image bearing member.

Further, yet another object of the present invention is to provide an image forming apparatus including: a first image bearing member that comes into contact with a recording material bearing member in a first contact area, and rotates while bearing a colored toner image; a first transfer member that comes into contact with the recording material bearing member, for electrostatically transferring the colored toner image to a recording material borne on the recording material bearing member, in a rotation direction of the first image bearing member, a distance between a most upstream end of the first contact area and the first transfer member being a first distance; a colored toner image forming portion for forming a colored toner image on the recording material; a second image bearing member that comes into contact with the recording material bearing member in a second contact area, and rotates while bearing a transparent toner image; a second transfer member that comes into contact with the recording material bearing member, for electrostatically transferring the transparent toner image to the intermediate transfer member, in a rotation direction of the second image bearing member, a distance between a most upstream end of the second contact area and the second transfer member being a second distance longer than the first distance; a transparent toner image forming portion provided on an upstream side with respect to the colored toner image forming portion in a moving direction of the intermediate transfer member, for forming a transparent toner image on the recording material such that the transparent toner image comes into contact with at least a part of the colored toner image on the recording material.

Further features of the present invention will become apparent from the following description of exemplary embodiments (with reference to the attached drawings).

DESCRIPTION OF THE EMBODIMENTS

Figure 16:
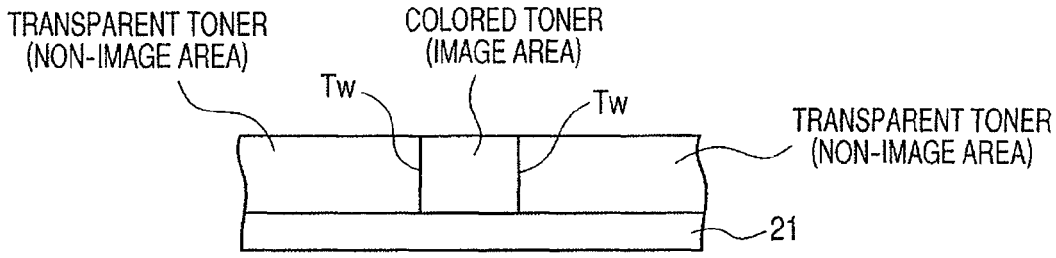
FIG. 16 is a view illustrating an influence of the toner scattering phenomenon with respect to an image composed of transparent toner and colored toner.

According to the present invention, "toner scattering" and "re-transfer" can be reduced concurrently. That is, by increasing a distance between a most upstream end of a contact area between an image bearing member and an intermediate transfer member or a recording material transport member, and a transfer member, the toner scattering of a transparent toner image is reduced. Then, a wall Tw of transparent toner with less scattering is formed as shown in FIG. 16. The wall Tw of transparent toner is formed so as to be adjacent to at least a part of a colored toner image. The toner scattering during the transfer of the colored toner image is reduced by the wall Tw. Herein, the wall Tw is formed of transparent toner, so the wall Tw does not hinder a toner image formed by second toner image forming means visually. Further, since a distance between the transfer member that transfers the colored toner image, and the most upstream end of the contact area between the image bearing member and the intermediate transfer member or the recording material bearing member is short, re-transfer of the transparent toner image during the transfer of the colored toner image can be reduced.

Hereinafter, embodiments of the present invention will be described in detail.

Embodiment 1

<Entire Configuration and Operation of Image Forming Apparatus>

Figure 1:
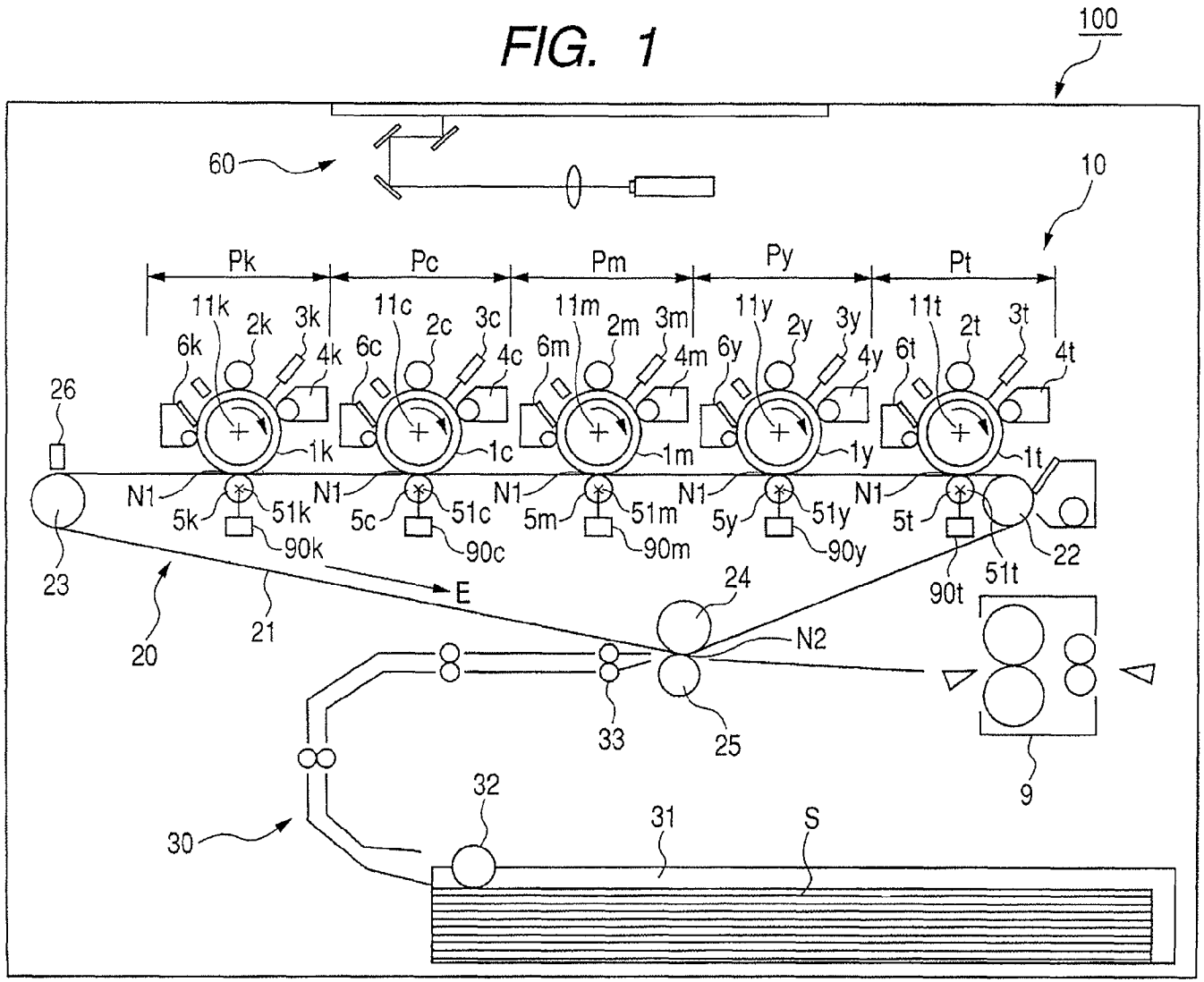
FIG. 1 is a schematic cross-sectional structural view of an embodiment of an image forming apparatus according to the present invention.

First, an entire configuration of an image forming apparatus of this embodiment will be described. FIG. 1 shows a schematic cross-sectional configuration of an image forming apparatus 100 of this embodiment. In this embodiment, the present invention is embodied by a so-called tandem-type image forming apparatus 100. The image forming apparatus 100 of this embodiment is a full-color image forming apparatus that is a compound machine having a copying function, a printer function, and a facsimile function. The image forming apparatus 100 can form a full-color image on a recording material (recording sheet, OHP sheet, cloth, etc.) S using an electrophotographic process, in accordance with an image information signal from an original reading apparatus 60 provided in an image forming apparatus body (apparatus body) A or an external device connected so as to be communicated, such as a computer, a facsimile machine, or a digital camera.

The image forming apparatus 100 includes a digital color image reader portion (original reading apparatus) 60 in an upper part of the figure, and a digital color image printer portion 10 in a lower part of the figure.

In the digital color image reader portion 60, an original is placed on an original table glass and is scanned by exposure with an exposure lamp. A reflected light image from the document is collected by a lens onto a full-color CCD sensor, whereby a color separation image signal is obtained. The color separation image signal is subjected to image processing in a video processing unit (not shown) via an amplifying circuit (not shown), and is sent out to the printer portion 10 via an image memory (not shown).

The printer portion 10 includes, as a plurality of image forming portions serving as toner image forming means, first, second, third, fourth, and fifth image forming portions Pt, Py, Pm, Pc, and Pk that form transparent (T), yellow (Y), magenta (M), cyan (C), and black (K) images, respectively. Further, the image forming apparatus 100 includes intermediate transfer units 20 for transferring images formed in the respective image forming portions Pt, Py, Pm, Pc, and Pk to the recording material S.

In this embodiment, the configurations of the respective image forming portions Pt, Py, Pm, Pc, and Pk are substantially the same, except for the kinds of developers to be used and the positions in the rotation direction of a photosensitive drum 1 of a primary transfer roller 5. Thus, hereinafter, unless particular discrimination is required, the image forming portions will be collectively described, omitting subscripts t, y, m, c, and k provided to the reference characters for discriminating elements of the respective colors.

The image forming portion P has a drum shaped electrophotographic photosensitive member (photosensitive drum) 1 as an image bearing member. The photosensitive drum 1 is supported rotatably in the direction represented by an arrow in the figure, and bears a toner image. On the periphery of the photosensitive drum 1, a charging roller 2 as charging means for charging the photosensitive drum 1, a laser exposure optical system 3 as exposure means for writing an electrostatic image by scanning the surface of the photosensitive drum 1 by exposure, a developing device 4 as developing means for supplying a developer to the electrostatic image formed on the photosensitive drum 1 to form a toner image, a cleaning device 6 as cleaning means for removing toner from the photosensitive drum 1, a primary transfer roller 5 for transferring the toner image on the photosensitive drum 1 to an intermediate transferring belt 21, and the like are placed. The intermediate transfer unit 20 having the intermediate transferring belt 21 as an intermediate transfer member is placed so as to be opposed to the photosensitive drum 1 of each image forming portion P.

The respective developing devices (first to fifth developing devices) 4*t*, 4*y*, 4*m*, 4*c*, and 4*k* provided in the respective image forming portions Pt, Py, Pm, Pc, and Pk are filled with developers having different spectral characteristics. In this embodiment, each developing device 4 is filled with a two-component developer in which toner (non-magnetic toner) and a carrier (magnetic carrier) are mainly mixed.

The developing devices (second to fifth developing devices) 4*y*, 4*m*, 4, and 4*k* of the second to fifth image forming portions Py, Pm, Pc, and Pk contain toner (specifically, colored toner) mainly containing resin and a pigment. On the other hand, the developing device (first developer) 4*t* of the first image forming portion Pt contains toner (transparent toner) mainly containing resin. To be more specific, as the colored toner, toner having a volume average particle diameter of about 8 mm is used, which is obtained by crushing and classifying a pigment kneaded in a polyester-based resin binder. Further, the transparent toner is composed of resin without a colorant, having a high light transmittance and an average particle diameter of 1 to 25 μm. As the material for forming the transparent toner, styrene-acrylic copolymer resin is used, which is obtained by copolymerization of a styrene-based monomer such as styrene, an acrylic ester monomer such as butyl acrylate, and/or a methacrylic ester monomer such as methyl methacrylate. Further, as the material for forming the transparent toner, thermoplastic resin such as polyester resin, and other thermosetting resin are used. The transparent toner is substantially colorless, and is satisfactorily transmitted through at least visible light without being scattered.

The toner in the developing device 4 is supplied at any time from a supply toner containing portion (hopper) (not shown) provided with respect to each developing device 4 so as to keep the density of toner (ratio of the weight of toner with respect to the entire weight of developers: toner proportion) or the amount of toner in the developing device 4 to be constant.

As described above, in this embodiment, each of the developing devices 4*t*, 4*y*, 4*m*, 4*c*, and 4*k* corresponds to one photosensitive drum. The image forming portions Pt, Py, Pm, Pc, and Pk each including a combination of one photosensitive drum 1, one developing device 4, and one primary transfer roller 5 are arranged in series in a transport direction (surface movement direction) E of the intermediate transferring belt 21.

The intermediate transfer unit 20 includes an intermediate transfer member serving as a belt member performing endless movement, i.e., the intermediate transferring belt 21, as an image transport member that directly bears and transports a toner image transferred from the image bearing member. In this embodiment, the intermediate transferring belt 21 is wound around three rollers: a drive roller 22, a driven roller 23, and a secondary transfer counter roller 24 in this embodiment. The intermediate transferring belt 21 turns (rotates) in a direction represented by an arrow E in the figure when a driving force is transmitted to the drive roller 22. On a back surface side of the intermediate transferring belt 21, at a position opposed to each photosensitive drum 1 with the intermediate transferring belt 21 interposed therebetween, a primary transfer roller 5 as a primary transfer portion is placed. Further, at a position opposed to the secondary transfer counter roller 24 via the intermediate transferring belt 21, a secondary transfer roller 25 as secondary transfer means is placed. For the intermediate transferring belt 21, a resin material such as polyimide, polycarbonate, PVDF (polyvinylidene fluoride), ETFE (ethylene-tetrafluoroethylene copolymer), PTFE (polytetrafluoroethylene), polyamide, PVC (polyvinyl chloride), PE (polyethylene), and PET (polyethylene terephthalate) is preferably used.

Next, an image forming operation will be described. An image signal from a computer, an image signal from a facsimile machine, and the like, as well as a signal from the digital color image reader portion 60 are similarly sent to the printer portion 10. Herein, the operation of the printer portion will be described based on the signal from the digital color image reader portion 60 as a representative. During image formation, the photosensitive drum 1 rotates in the direction represented by the arrow in the figure. The surface of the photosensitive drum 1 is uniformly charged by the charging roller 2. Then, the surface of the charged photosensitive drum 1 is irradiated with a light image of separated color corresponding to each of the image forming portions Pt, Py, Pm, Pc, and Pk, and an electrostatic image (latent image) is formed on the photosensitive drum 1.

The latent image on the photosensitive drum 1 is developed by an inversion phenomenon with the developing device 4. To be more specific, in this embodiment, the developing device 4 allows toner charged in the same polarity (negative polarity in this embodiment) as the charging polarity of the photosensitive drum 1 to adhere to a portion on the photosensitive drum 1 from which charge is removed by exposure. Consequently, a developer image (toner image) is formed on the photosensitive drum 1. At this time, a developing roller of the developing device 4 as a developer bearing member that bears and transports a developer to a developing area opposed to the photosensitive drum 1 is supplied with a developing bias.

The toner image formed on the photosensitive drum 1 is primarily transferred electrostatically onto the intermediate transferring belt 21 as a transfer medium, owing to the function of the primary transfer roller 5, in a primary transfer portion N1 that is a contact portion between the photosensitive drum 1 and the intermediate transferring belt 21. At this time, the primary transfer roller 5 is supplied with a predetermined primary transfer bias from a primary transfer bias power supply 90 as primary transfer bias application means.

In this embodiment, in the first image forming portion Pt that forms a transparent image as a toner image of transparent toner, a transparent image corresponding to a non-image portion of an original image is formed. Then, in the second to fifth image forming portions Py, Pm, Pc, and Pk, a colored image corresponding to an image portion of an original image is formed. Herein, the document image refers to an image information signal which is converted to an electric signal in the original reading apparatus 60 and defines an image to be output. Further, as the document image, there is an image information signal transmitted from an external device such as a computer, a facsimile machine, or a digital camera which is connected to the image forming apparatus 100 so as to be communicated. Further, the image portion of an original image refers to a portion to be formed of colored toner defined by the image information signal, and the non-image portion of an original image refers to a portion other than an area to be formed of colored toner that is defined by the image information signal in an image formable area of the apparatus. A wall Tw (shown in FIG. 16) of transparent toner may be formed by forming a transparent image corresponding to at least a non-image portion, using transparent toner, and if desired, a method of placing a predetermined amount of transparent toner on an image portion may be used.

That is, the colored toner image forming portions Py, Pm, Pc, and Pk form toner images on the intermediate transferring belt 21 that bears a toner image formed by the transparent toner image forming portion Pt. The transparent toner image forming portion Pt, which is first toner image forming means for forming a toner image in the first order, forms a toner image using transparent toner in an area adjacent to the area where the colored toner image forming portions Py, Pm, Pc, and Pk, which are the second toner image forming means for forming toner images in the second and subsequent orders, form toner images.

Figure 17:
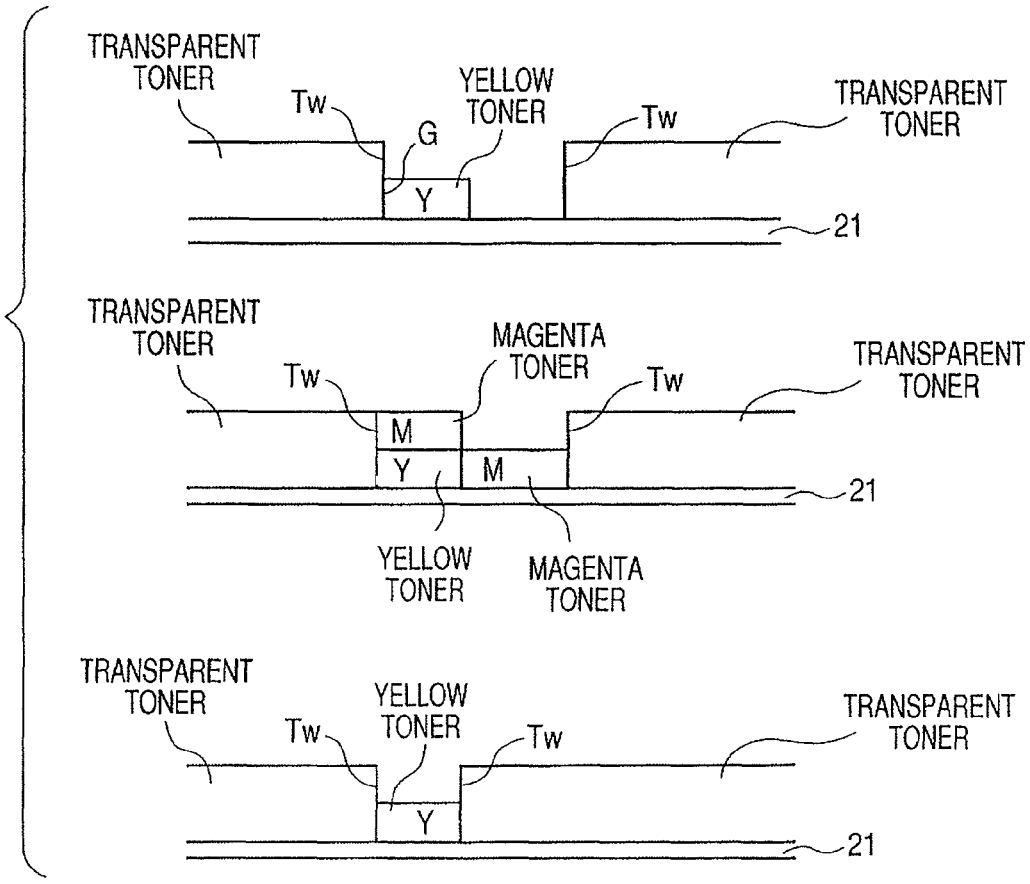
FIG. 17 is a view showing a method of allowing the transparent toner image to come into contact with the colored toner image.

Herein, as shown in FIG. 17*b*, in the case of forming a magenta toner image adjacent to a yellow toner image, a transparent toner image is provided adjacent to only a part (point G) of the yellow toner as shown in FIG. 17*a*.

Further, as shown in FIG. 17*c*, in the case where another colored toner image is not formed adjacent to a yellow toner image, a transparent toner image is provided adjacent to a yellow toner image so as to surround the yellow toner image.

For example, at a time of forming a full-color image, first, a transparent toner image corresponding to a non-image portion of an original image is primarily transferred onto the intermediate transferring belt 21 in the first image forming portion Pt. After that, in the respective second to fifth image forming portions Py, Pm, Pc, and Pk, images of respective component colors (yellow, magenta, cyan, and black) of an image portion of an original image are successively primarily transferred onto the intermediate transferring belt 21 so as to be superimposed. Consequently, a full-color toner image is formed on the intermediate transferring belt 21. A monochrome image of any one of yellow, magenta, cyan, and black or a multi-color image of a combination of some of these colors may be formed. Even in this case, an image of transparent toner can be formed in a non-image portion in the same way as in the formation of the above-mentioned full-color image.

The toner images on the intermediate transferring belt 21 are secondarily transferred collectively to the recording material S owing to the function of the secondary transfer roller 25 in the secondary transfer portion N2 that is contact portion between the intermediate transferring belt 21 and the secondary transfer roller 25. At this time, the secondary transfer roller 25 is supplied with a secondary transfer bias from a secondary transfer bias power supply (not shown) as secondary transfer bias application means.

The recording material S is transported from recording material supply means 30 to the secondary transfer portion N2. That is, in the recording material supply means 30, the recording material S accommodated in the recording material accommodating portion (cassette) 31 is fed by a pickup roller 32 or the like on a one-by-one basis, and transported to the secondary transfer portion N2 at a desired timing after being corrected for skew by a resist roller 33.

The recording material S with the toner image transferred thereon in the secondary transfer portion N2 is transported to a heat roller fixing device 9 as fixing means through a transporting portion. The recording material S is discharged to a delivery tray or a post-processing apparatus (not shown) after the toner image is fixed thereon by the heat roller fixing device 9.

On the other hand, the toner (primary transfer residual toner) remaining on the photosensitive drum 1 after the primary transfer step is collected by the cleaning device 6. Further, the toner (secondary transfer residual toner) remaining on the intermediate transferring belt 21 after the secondary transfer step is collected by a transfer cleaning device (not shown).

At a position opposed to the driven roller 23 on a downstream side in the movement direction of the intermediate transferring belt 21 from the fifth image forming portion Pk, a sensor (optical sensor) 26 for detecting the misregistration and image density for predetermined control is placed. The image for control is transferred from the photosensitive drums 1*t*, 1*y*, 1*m*, 1*c*, and 1*k* of the respective image forming portions Pt, Py, Pm, Pc, and Pk to the intermediate transferring belt 21. The driven roller 23 is a roller that forms a transfer surface of the intermediate transferring belt 21 between the driven roller 23 and the drive roller 22. At any time, in the respective image forming portions Pt, Py, Pm, Pc, and Pk, control of correcting the image density, a toner supply amount, an image writing timing, an image writing start position, and the like is performed.

<Suppression of Toner Scattering and Reduction in Re-Transfer Toner Amount>

Next, the configuration of the primary transfer portion N1, which is most characteristic in this embodiment, will be described in more detail.

In this embodiment, a transparent toner image corresponding to a non-image portion of an original image is formed, and the periphery of a colored toner image is surrounded by the transparent toner image, whereby the pre-transfer of a colored toner image is suppressed, and toner scattering phenomenon can be prevented.

When the toner scattering of a transparent toner image itself occurs, the effect of suppressing the toner scattering of a colored toner image by surrounding the periphery of colored toner with transparent toner is reduced.

Figure 13:
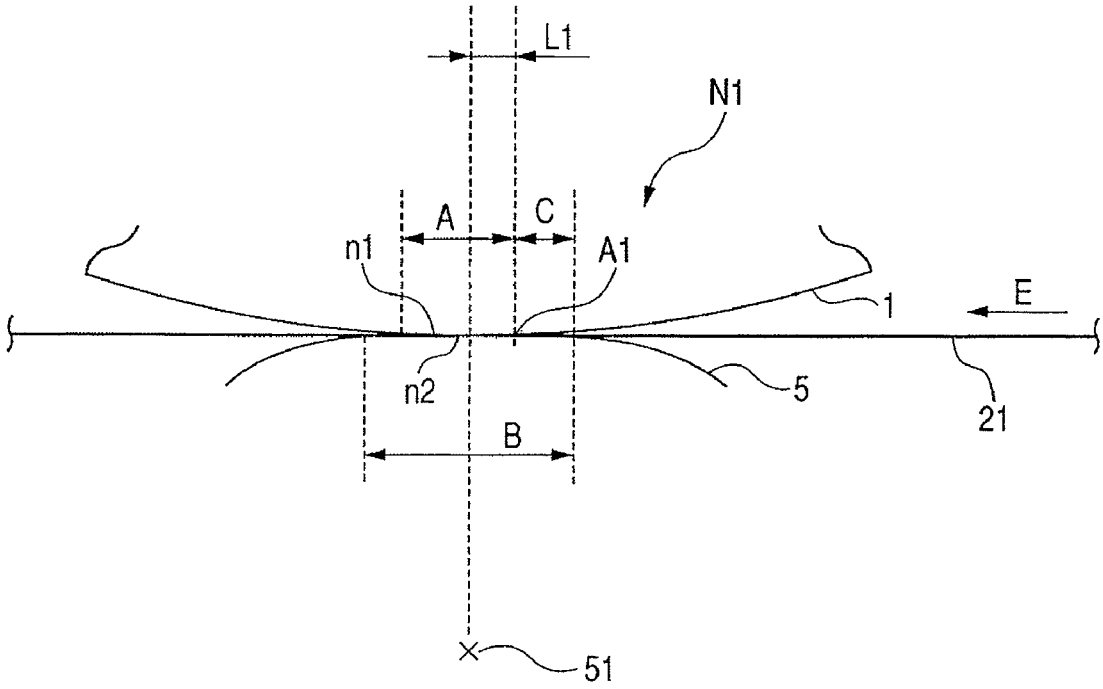
FIG. 13 is a view illustrating a toner scattering phenomenon.
Figure 14:
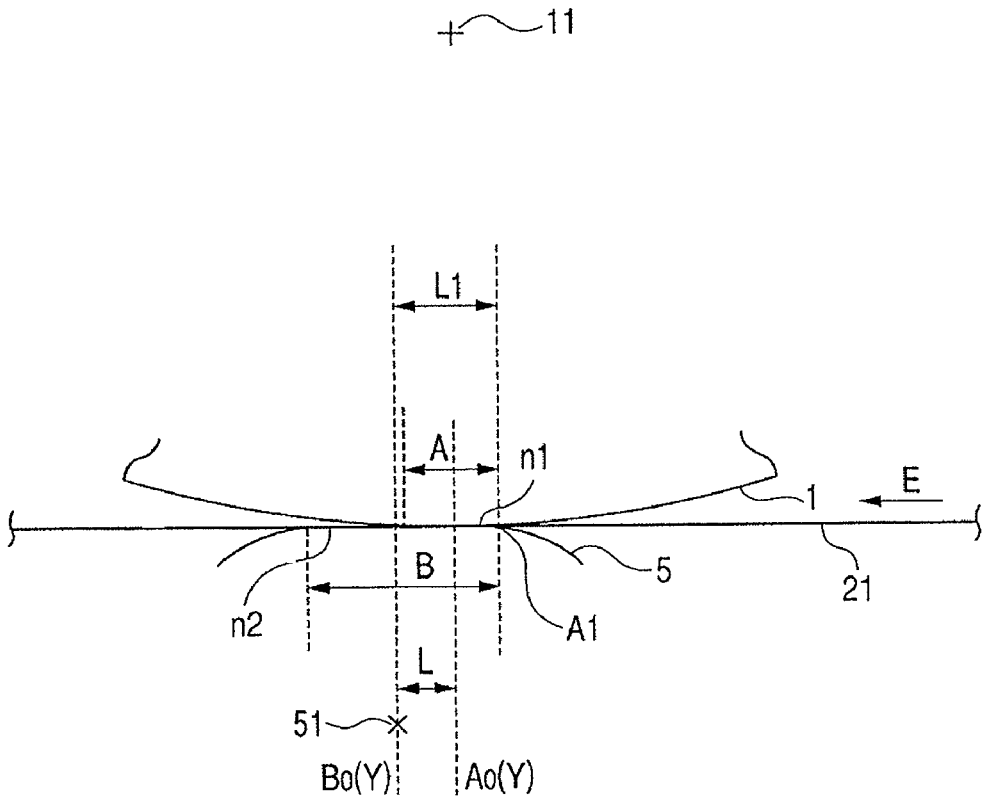
FIG. 14 is a view illustrating a principle of a method of reducing the toner scattering phenomenon.
Figure 15:
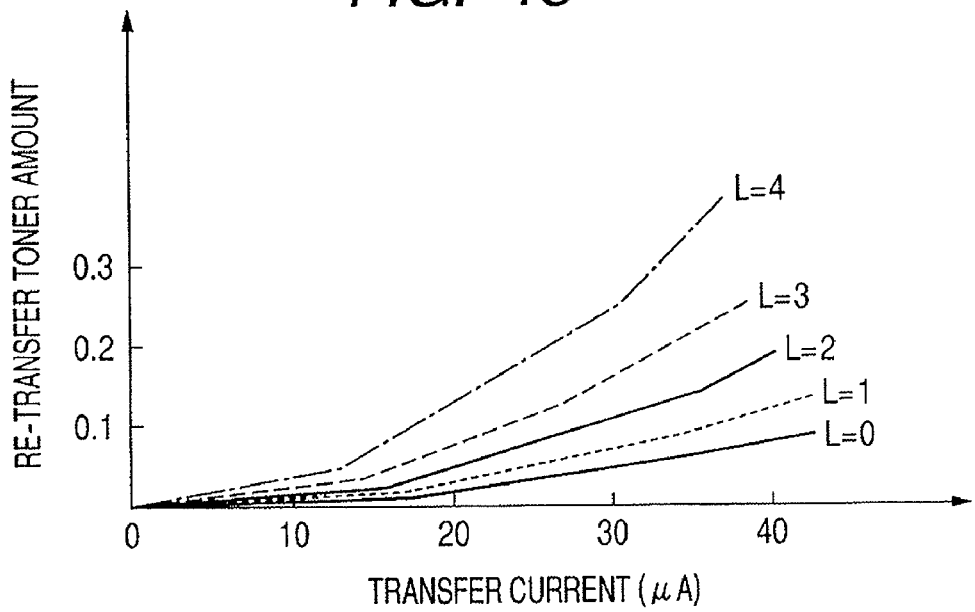
FIG. 15 is a graph showing a relationship between an offset value and a re-transfer amount.

On the other hand, as described above with reference to FIGS. 13 and 14, in order to suppress the pre-transfer and prevent the toner scattering phenomenon, it is effective to reduce the upstream side gap nip area C in which the pre-transfer occurs. For this purpose, typically, the center (i.e., the center of the area B) $B_0$ in the movement direction of the intermediate transferring belt 21 of the second contact nip n2 formed between the intermediate transferring belt 21 and the primary transfer roller 5 is offset to a downstream side in the movement direction of the intermediate transferring belt 21 relatively with respect to the center (i.e., the center of the area A) $A_0$ in the movement direction of the intermediate transferring belt 21 of the first contact nip n1 formed between the photosensitive drum 1 and the intermediate transferring belt 21.

That is, in the rotation direction of the photosensitive drum 1, the distance L1 of the primary transfer roller 5 from the upstream end A1 of the area A is increased. Herein, the distance L1 corresponds to a distance from the upstream end A1 of the area A to the rotation center of the transfer roller 5 in the rotation direction of the photosensitive drum 1.

However, when the center $B_0$ of the area B (belt-roller contact area) is offset to a downstream side relatively with respect to the center $A_0$ of the area A (drum-belt contact area) in the movement direction of the intermediate transferring belt 21, that is, the above-mentioned L1 is increased, the re-transfer toner amount is increased.

In this embodiment, the image forming portion (transparent toner image forming portion) Pt that forms a toner image of transparent toner is placed on a most upstream side in the movement direction of the intermediate transferring belt 21. That is, the primary transfer portion N1 which the intermediate transferring belt 21 having passed through the secondary transfer portion N2 reaches first is the primary transfer portion N1 of the transparent toner image forming portion Pt. The intermediate transferring belt 21 having passed through the secondary transfer portion N2 passes through the primary transfer portion N1 of the transparent toner image forming portion Pt, and then passes through the primary transfer portions N1 of the colored toner image forming portions Py, Pm, Pc, and Pk.

Figure 4:
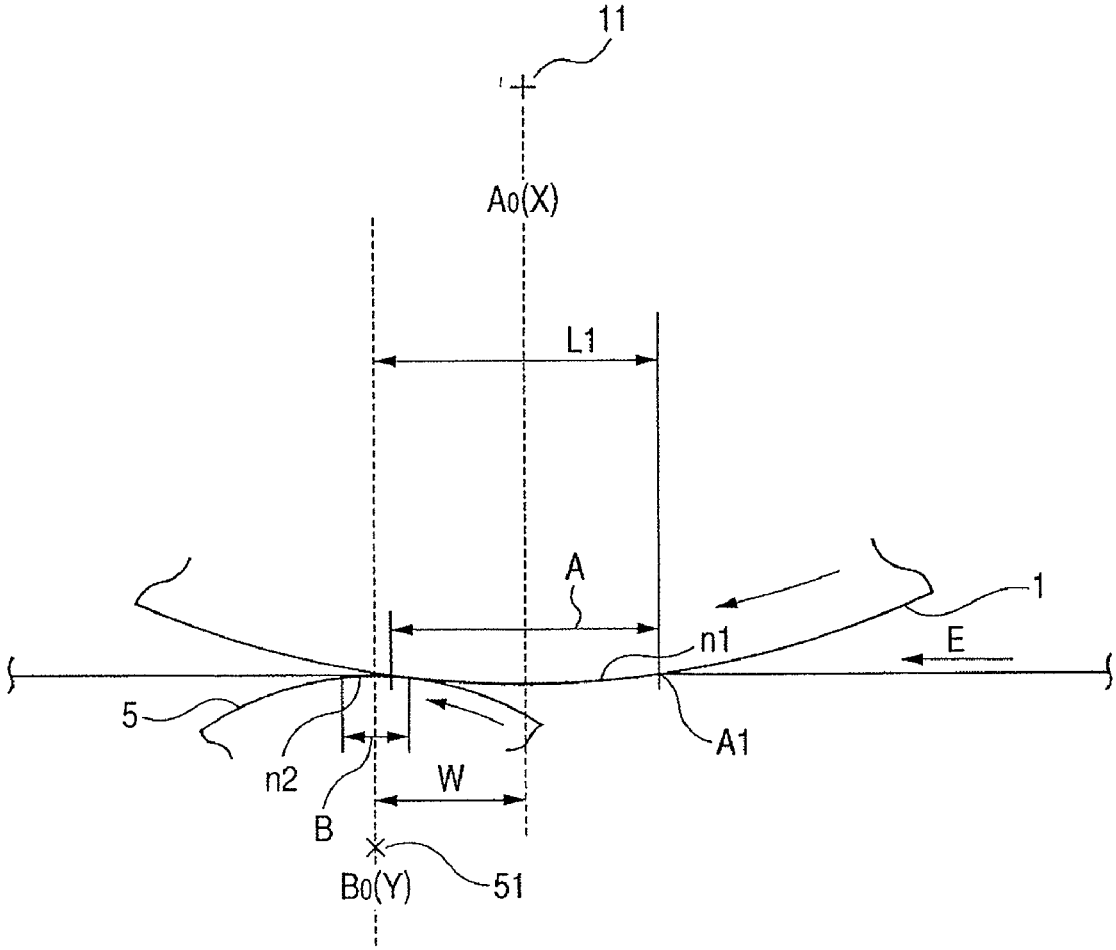
FIG. 4 is a view illustrating a transfer portion in the transparent toner image forming portion.

Then, as shown in FIG. 4, at least in the transparent toner image forming portion Pt, the center $B_0$ of the area B in the movement direction of the intermediate transferring belt 21 is offset to a downstream side in the movement direction of the intermediate transferring belt 21 relatively with respect to the center $A_0$ of the area A in the movement direction of the intermediate transferring belt 21.

To be more specific, in this embodiment, the transparent toner image forming portion Pt is placed at a most upstream position, at which a toner image is not transferred onto the intermediate transferring belt 21 on an upstream side of the image forming portion thereof and it is not necessary to consider the re-transfer of toner having transferred onto the intermediate transferring belt 21.

Then, in the transparent toner forming portion Pt serving as first toner image forming means for forming a toner image in the first order, in the movement direction of the intermediate transferring belt 21, the center $B_0$ of the area B is offset to the downstream side relatively from the center $A_0$ of the area A. That is, the distance (hereinafter, referred to also as "offset value") W from the center $A_0$ of the area A to the center $B_0$ of the area B on the downstream side in the movement direction of the intermediate transferring belt 21 is set to be larger than 0 mm. Herein, in this embodiment, A is 2 mm. Thus, when the distance W is 0 mm, L1 is 1 mm. That is, when the distance W is set to be larger than 0 mm, the distance L1 becomes larger than 1 mm.

Thus, in the transparent toner image forming portion Pt, the upstream side gap nip area C that causes the toner scattering phenomenon can be reduced as much as possible, and preferably, can be eliminated substantially.

By setting the arrangement relationship between the areas A and B in the transparent toner image forming portion Pt as described above, as shown in FIG. 16, the wall Tw of transparent toner, for reducing the scattering of toner transferred onto the intermediate transferring belt 21 in the image forming portion on a downstream side of the transparent toner image forming portion Pt, can be prevented from being degraded.

Figure 5:
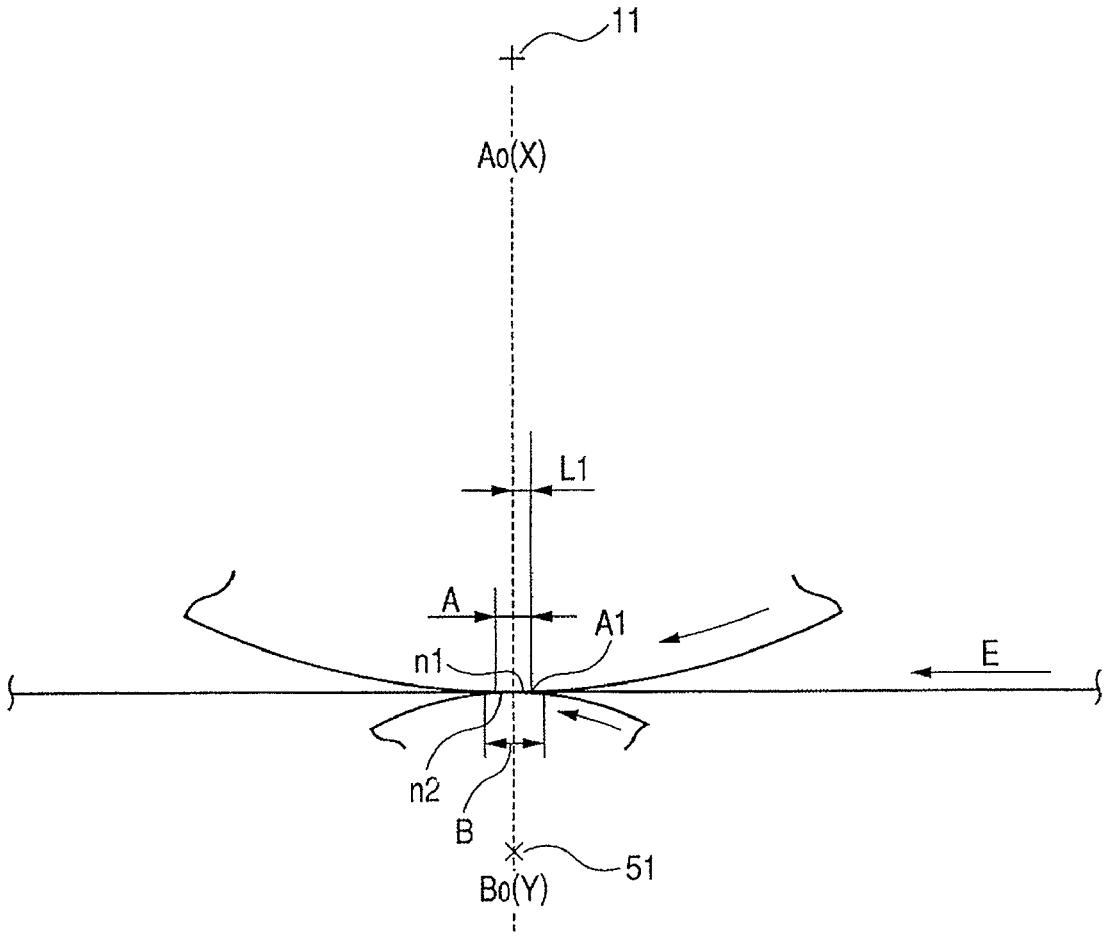
FIG. 5 is a view illustrating a transfer portion in the colored toner image forming portion.

On the other hand, regarding the image forming portions (second to fifth image forming portions) on a downstream side of the transparent toner image forming portion Pt, which form toner images in the second and subsequent orders, i.e., the respective colored toner image forming portions Py, Pm, Pc, and Pk for forming colored toner images of yellow, magenta, cyan, and black, as shown in FIG. 5, a distance (offset value) W from the center $A_0$ of the area A to the center $B_0$ of the area B on a downstream side in the movement direction of the intermediate transferring belt 21 is set to be smaller than that in the transparent toner image forming portion Pt. In this embodiment, the offset value W in the respective colored toner image forming portions Py, Pm, Pc, and Pk is set to be 0 mm, whereby the center of the area A is matched with the center of the area B in the movement direction of the intermediate transferring belt 21.

That is, the position in the rotation direction of a photosensitive drum 1*t* of a primary transfer roller 5*t* of the transparent toner image forming portion Pt is on a downstream side of the positions in the rotation direction of the photosensitive drums 1*y*, 1*m*, 1*c*, and 1*k* of the primary transfer rollers 5*y*, 5*m*, 5*c*, and 5*k* of the colored toner image forming portions Py, Pm, Pc, and Pk. That is, the position of the primary transfer roller 5 with respect to the developing device 4 in the rotation direction of the photosensitive drum 1 in the transparent toner image forming portion Pt is on a downstream side of the position of the primary transfer roller 5 with respect to the developing device 4 in the rotation direction of the photosensitive drum 1 in the colored toner image forming portions Py, Pm, Pc, and Pk.

In this embodiment, assuming that a vertical line from the rotation shaft of the photosensitive drum 1 to the surface of the intermediate transferring belt 21 is a photosensitive drum center line X, the photosensitive drum center line X is substantially matched with the center $A_0$ of the area A. Further, assuming that a vertical line from the rotation shaft of the primary transfer roller 5 to the surface of the intermediate transferring belt 21 is a transfer roller center line Y, the transfer roller center line Y is substantially matched with the center $B_0$ of the area B.

Thus, in this embodiment, in the transparent toner image forming portion Pt, the rotation shaft of the primary transfer roller 5 is placed on a downstream side in the movement direction of the intermediate transferring belt 21 with respect to the rotation shaft of the photosensitive drum 1, and the transfer roller center line Y is offset to a downstream side in the movement direction of the intermediate transferring belt 21 with respect to the photosensitive drum center line X. On the other hand, in the colored toner image forming portions Py, Pm, Pc, and Pk, the rotation shaft of the primary transfer roller 5 is placed so as to be opposed to the rotation shaft of the photosensitive drum 1, whereby the transfer roller center line Y is substantially matched with the photosensitive drum center line X.

Figure 2:
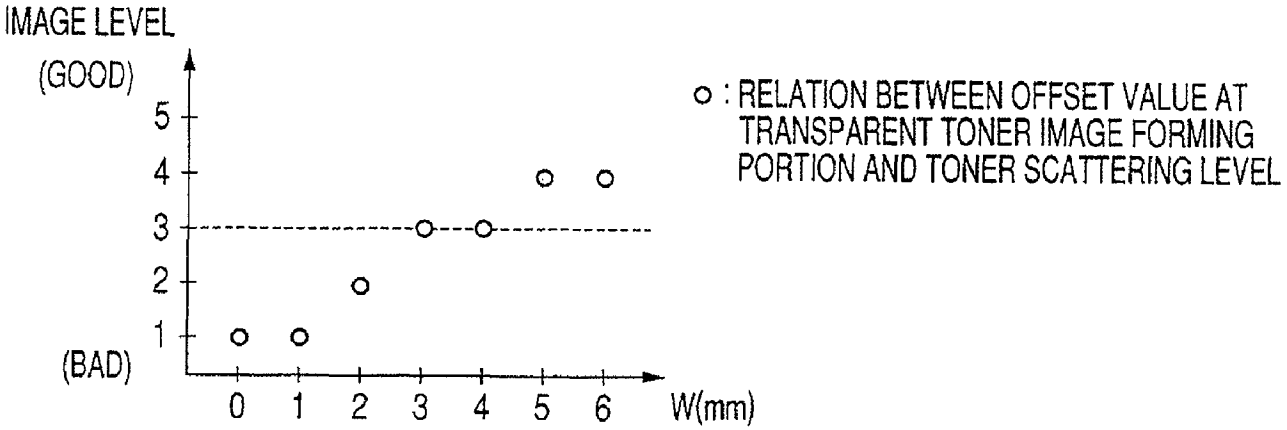
FIG. 2 is a graph showing a relationship between an offset value in a transparent toner image forming portion and a toner scattering level.

FIG. 2 shows results obtained by evaluating the occurrence situation of scattering phenomenon when the offset value W in the transparent toner image forming portion Pt is varied, with a character scatting amount. Herein, since the visibility of transparent toner is poor, it is difficult to quantify the toner scattering amount of the transparent toner. Therefore, by using magenta toner in place of transparent toner as a developer of the transparent toner image forming portion Pt, the toner scattering amount in the transparent toner image forming portion Pt was confirmed.

Herein, the toner scattering amount was measured as follows. A line image of 10 p was output, and the following levels were set based on the number of toner particles transferred outside of an image (both sides of a line image area) per 100 μm of a line image.

0: level 5
1 to 3: level 4
4 to 6: level 3
7 to 9: level 2
10 or more: level 1

The scattering phenomenon of the image level 3 or higher, which is a level negligible by visual inspection, was set to be an image without problem.

As shown in FIG. 2, by setting the offset value W in the transparent toner image forming portion Pt to be 3 mm or more, the influence of toner scattering phenomenon was reduced.

Figure 3:
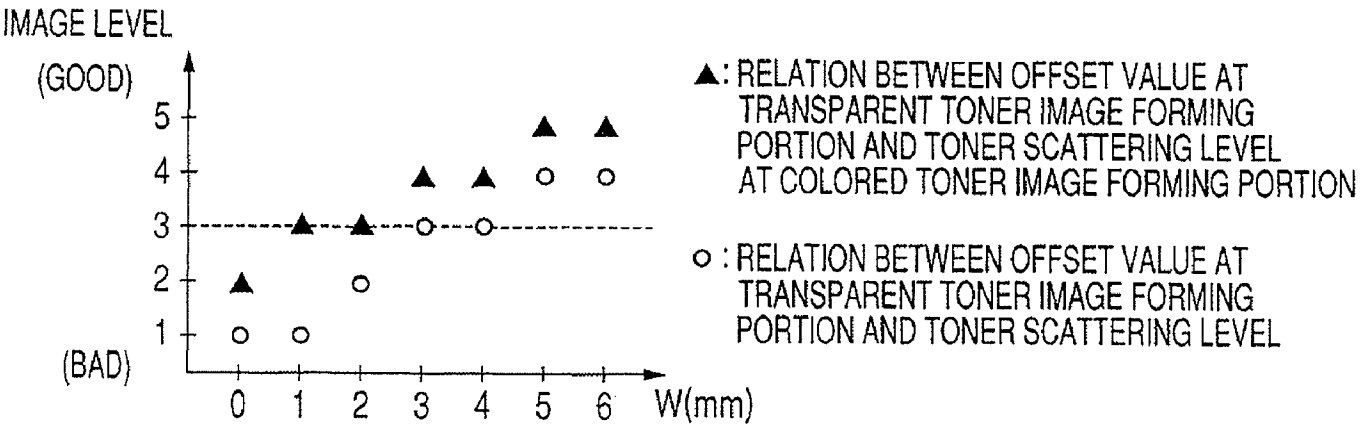
FIG. 3 is a graph showing a relationship between the offset value in the transparent toner image forming portion and a toner scattering level in a colored toner image forming portion.

Next, FIG. 3 shows results obtained by confirming the occurrence situation of toner scattering phenomenon in a colored toner image forming portion positioned on a downstream side, when the offset value W in the transparent toner image forming portion Pt is varied. Herein, the results were obtained by measuring and evaluating the scattering amount of yellow toner in the yellow toner image forming portion Py that is the second image forming portion as a representative using the same measurement method as the above.

As shown in FIG. 3, owing to the effect of surrounding colored toner with transparent toner, the influence of toner scattering phenomenon in the yellow toner image forming portion was reduced by setting the offset value W in the transparent toner image forming portion Pt to be 1 mm or more. By setting the offset value W in the transparent toner image forming portion Pt to be 5 mm and 6 mm, images of higher quality were obtained.

Herein, as the offset value W is increased, a portion (downstream side gap nip) of the second contact nip n2 that extends off a downstream side in the movement direction of the intermediate transferring belt 21 relatively increases with respect to the first contact nip n1. Therefore, a required transfer voltage tends to further increase as the offset value W is increased. Thus, in this embodiment, the offset value W in the transparent toner image forming portion Pt was set to be 5 mm. In the transparent toner image forming portion Pt, L1 is 6 mm.

As described above, by setting the offset value W in the transparent toner image forming portion Pt to be 5 mm, the toner scattering phenomenon caused by the pre-transfer occurring in the upstream side gap nip C in the transparent toner image forming portion Pt can be prevented. Because of this, the wall Tw (shown in FIG. 16) of transparent toner with less degradation of an image was able to be formed, and the scattering of colored toner was able to be reduced.

Further, by setting the offset value W to be 0 mm in the second to fifth image forming portions Py, Pm, Pc, and Pk, the amount of re-transfer toner in the image forming portions Py, Pm, Pc, and Pk was able to be suppressed to a degree causing no problem. In the colored toner image forming apparatuses Py, Pm, Pc, and Pk, L1 is 1 mm.

In this embodiment, as the intermediate transferring belt 21, a belt with a thickness of 85 μm was used. Further, regarding all the image forming portions Pt, Py, Pm, Pc, and Pk, the outer diameter of the photosensitive drum 1 was 30 mm, and the outer diameter of the primary transfer roller 5 was 16 mm.

Further, in this embodiment, in the transparent toner image forming portion Pt and the colored toner image forming portions Py, Pm, Pc, and Pk, the nip width was about 2 to 4 mm in both the areas A and B.

The optimum offset value W in the transparent toner image forming portion Pt varies depending upon the diameter of the photosensitive drum 1, the kind thereof, the diameter of the transfer roller, the kind thereof, the kind of toner, the transfer current value, of the like. Thus, the offset value W in the transparent image forming portion Pt is not limited to that in the above-mentioned embodiment.

In this embodiment, in the colored toner image forming portions Py, Pm, Pc, and Pk that are the second to fifth image forming portions, the offset value W was set to be 0. This is extremely preferable because the re-transfer toner amount in the second to fifth image forming portions Py, Pm, Pc, and Pk can be reduced as much as possible. However, if desired, the offset value W may be set to be larger than 0 mm in a range in which the re-transfer toner amount in these image forming portions can be suppressed to a degree causing no problem. That is, in the colored toner image forming portions Py, Pm, Pc, and Pk that are the second to fifth image forming portions, the center $B_0$ of the area B may be offset to a downstream side in the movement direction of the intermediate transferring belt 21 with respect to the center $A_0$ of the area A. The offset value W may be the same or different among the second to fifth image forming portions. In this case, the offset value W in the transparent toner image forming portion Pt that is the first image forming portion is set to be larger than the offset value W in the colored toner image forming portions Py, Pm, Pc, and Pk that are the second to fifth image forming portions. Because of this, the degradation of the wall Tw of transparent toner formed by the transparent toner image forming portion Pt that is the first image forming portion can be reduced as much as possible. Further, the toner scattering phenomenon in the colored toner image forming portions Py, Pm, Pc, and Pk that are the second to fifth image forming portions can be suppressed.

Figure 6:
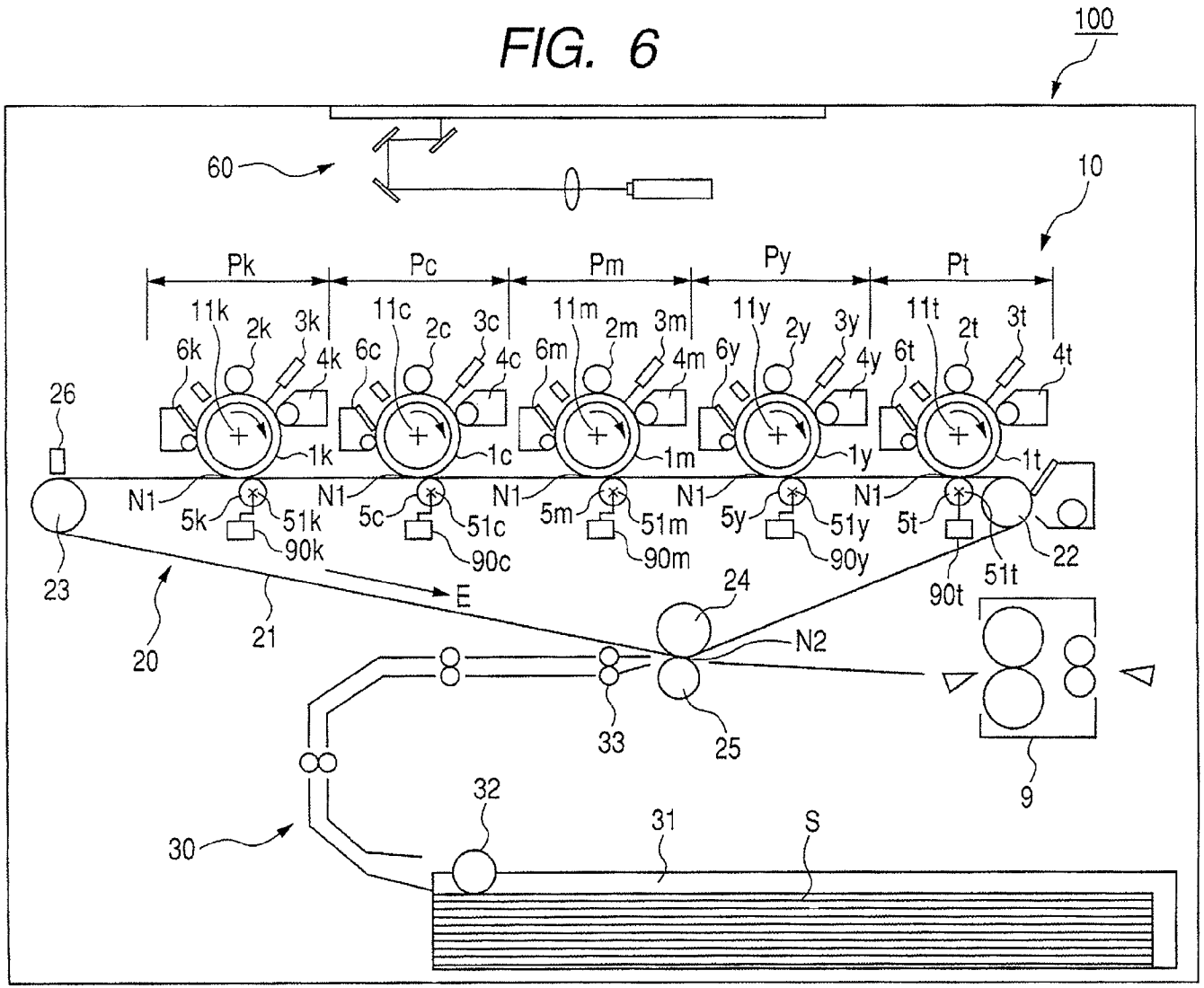
FIG. 6 is a schematic cross-sectional structural view of another embodiment of an image forming apparatus according to the present invention.

Further, as shown in FIG. 6, the primary transfer roller 5 of the colored toner image forming portions Py, Pm, Pc, and Pk may be positioned on an upstream side in the movement direction of the intermediate transferring belt 21. Because of this, in the same way as that described above, the position in the rotation direction of the photosensitive drum 1*t* of the primary transfer roller 5*t* of the transparent toner image forming portion Pt can be placed on a downstream side of the positions in the rotation direction of the photosensitive drums 1*y*, 1*m*, 1*c*, and 1*k* of the primary transfer rollers 5*y*, 5*m*, 5*c*, and 5*k* of the colored toner image forming portions Py, Pm, Pc, and Pk. With this configuration, the same effect as that described above can be obtained. For example, regarding the primary transfer roller 5 of the colored toner image forming portions Py, Pm, Pc, and Pk, the offset value W is set to be 5 mm on an upstream side in the movement direction of the intermediate transferring belt 21. Further, regarding the primary transfer roller 5 of the transparent toner image forming portion Pt, the offset value W is set to be 0 mm.

As described above, according to this embodiment, the toner scattering phenomenon and the amount of re-transfer toner can be reduced.

Embodiment 2

Next, another embodiment of the present invention will be described. The basic configuration and operation of the image forming apparatus of this embodiment are the same as those in Embodiment 1. Therefore, the elements having the configurations and functions that are substantially the same as or similar to those in the image forming apparatus in Embodiment 1 are denoted with the same reference numerals as those therein, and the detailed description thereof will be omitted.

In Embodiment 1, the rotation shaft of the primary transfer roller 5 is offset to a downstream side in the movement direction of the intermediate transferring belt 21 with respect to the rotation shaft of the photosensitive drum 1, that is, the transfer roller center line Y is offset to a downstream side in the movement direction of the intermediate transferring belt 21 with respect to the photosensitive drum center line X, whereby the center $B_0$ of the area B (belt-roller contact area) is offset to a downstream side with respect to the center $A_0$ of the area A (drum-belt contact area) in the movement direction of the intermediate transferring belt 21.

In this embodiment, the center $B_0$ of the area B is offset to a downstream side with respect to the center $A_0$ of the area A in the movement direction of the intermediate transferring belt 21, without offsetting the center shaft of the primary transfer roller 5 on a downstream side in the movement direction of the intermediate transferring belt 21 with respect to the center shaft of the photosensitive drum 1.

Figure 7:
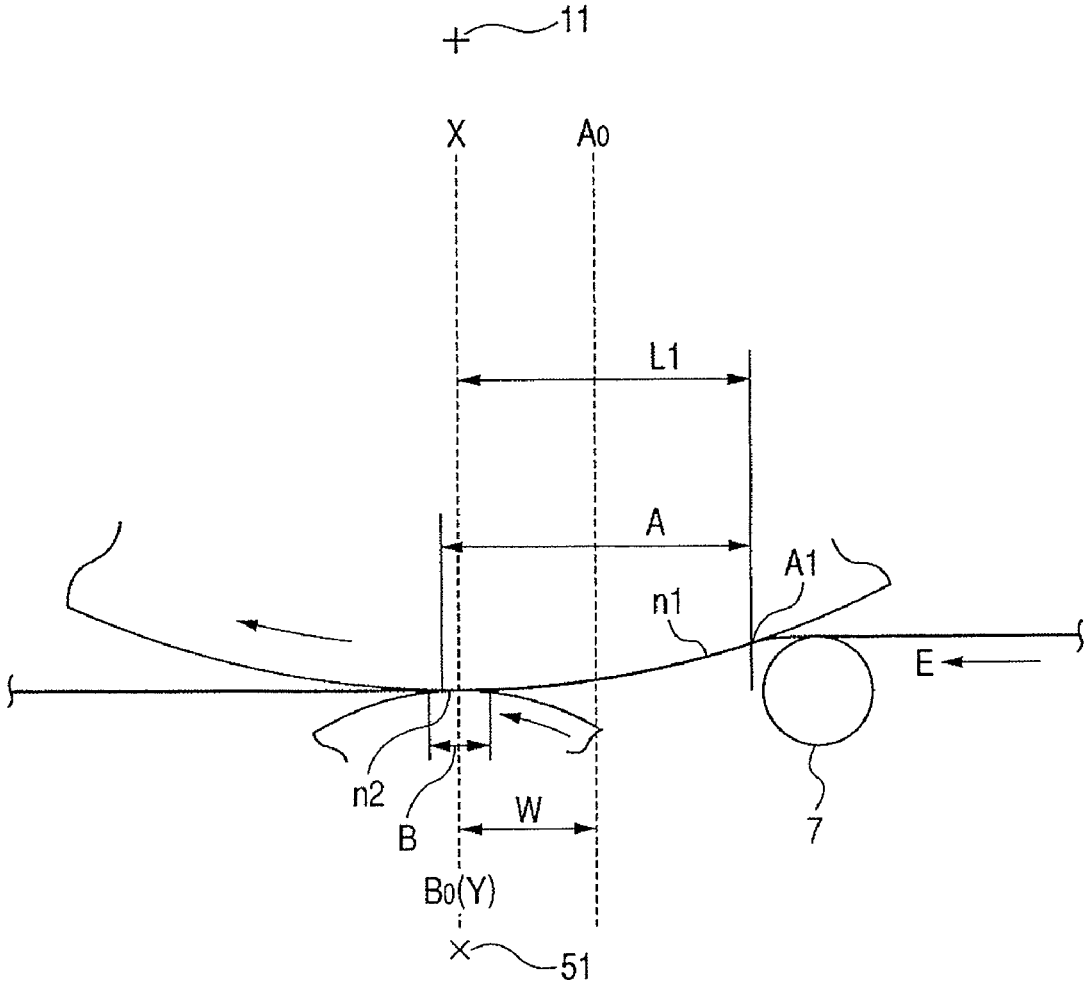
FIG. 7 is a view illustrating a transfer portion in a transparent toner image forming portion.

To be more specific, in this embodiment, as shown in FIG. 7, a lift roller 7 is provided as a biasing member for biasing the intermediate transferring belt 21 toward the photosensitive drum 1 on an upstream side in the movement direction of the intermediate transferring belt 21 from the primary transfer roller 5. The lift roller 7 lifts up the intermediate transferring belt 21 to the photosensitive drum 1 side, thereby extending the area A to an upstream side in the movement direction of the intermediate transferring belt 21. Because of this, in the movement direction of the intermediate transferring belt 21, the center $B_0$ of the area B is offset to a downstream side with respect to the center $A_0$ of the area A, whereby the upstream side gap nip C causing toner scattering can be eliminated.

In this embodiment, the photosensitive drum 1, the primary transfer roller 5, and the intermediate transferring belt 21 having the configurations similar to those of Embodiment 1 were used. In particular, in the transparent toner image forming portion Pt that is the first image forming portion for forming a toner image in the first order, a roller with an outer diameter of 16 mm is provided as the lift roller 7. The areas A and B were set to be 13 mm and 3 mm, respectively, and the distance (offset value) W from the center $A_0$ of the area A to the center $B_0$ of the area B was set to be 5 mm. At this time, L1 is 8 mm.

On the other hand, in the colored toner image forming portions Py, Pm, Pc, and Pk that are the second to fifth image forming portions for forming toner images in the second and subsequent orders, the rotation shaft of the photosensitive drum 1 is opposed to the rotation shaft of the primary transfer roller 5 in the movement direction of the intermediate transferring belt 21 in the same way as in Embodiment 1. In the colored toner image forming portions Py, Pm, Pc, and Pk, the center $A_0$ of the area A was matched with the center $B_0$ of the area B (W=0 mm) without providing the lift roller. At this time, the width of the area A is 2 mm, and L1 is 1 mm.

Thus, in this embodiment, the same effect as that of Embodiment 1 can be obtained by providing the lift roller 7 without offsetting the rotation shaft of the primary transfer roller 5 to a downstream side in the movement direction of the intermediate transferring belt 21 with respect to the rotation shaft of the photosensitive drum 1.

Embodiment 3

Figure 8:
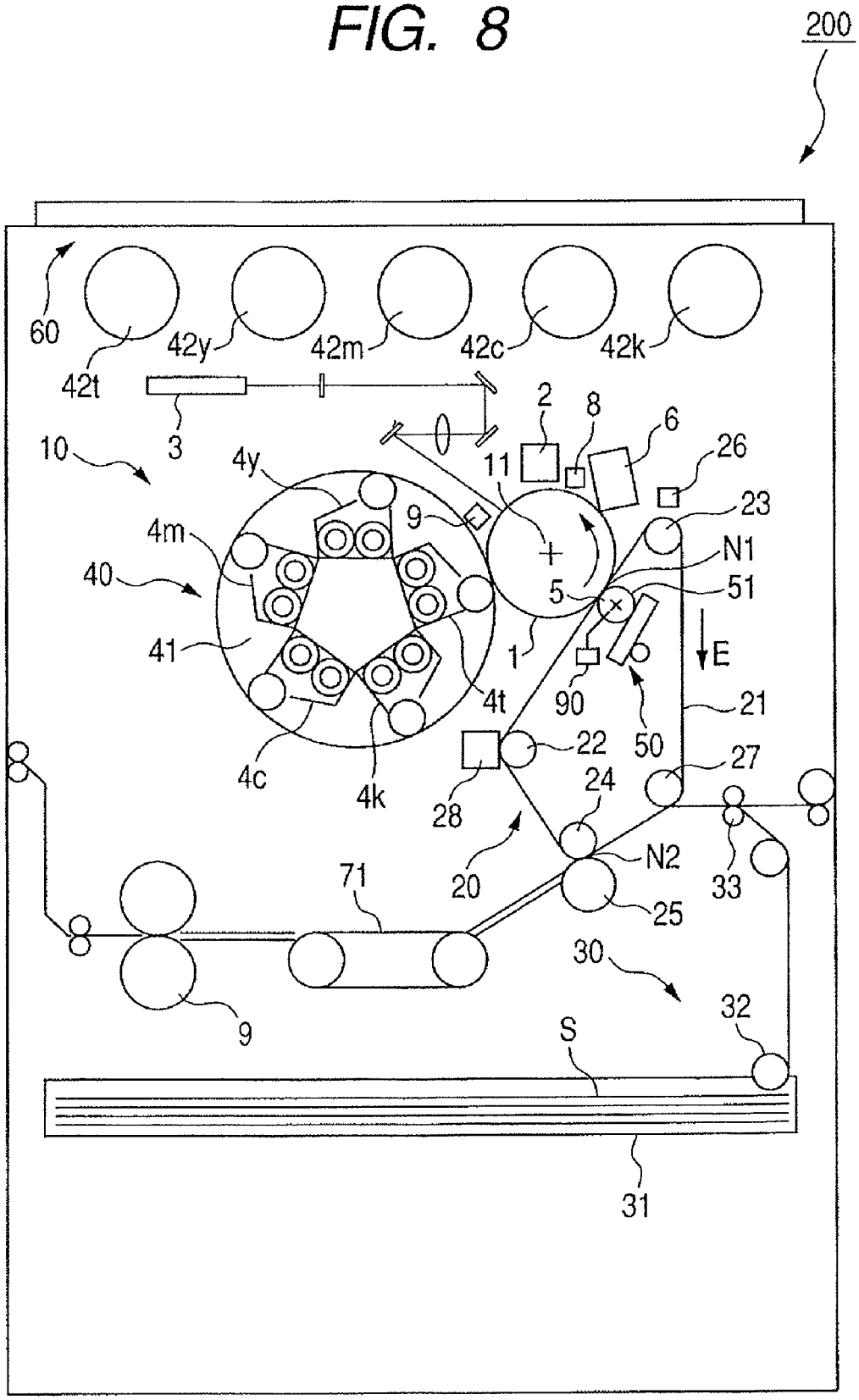
FIG. 8 is a schematic cross-sectional structural view of still another embodiment of an image forming apparatus according to the present invention.

Next, still another embodiment of the present invention will be described. FIG. 8 shows a schematic cross-sectional configuration of an image forming apparatus 200 of this embodiment. In this embodiment, the present invention is embodied in a so-called rotary-type image forming apparatus.

<Entire Configuration and Operation of Image Forming Apparatus>

An image forming apparatus 200 includes a digital color image reader portion (original reading apparatus) 60 similar to that of the image forming apparatus 100 of Embodiment 1, and a digital color image printer portion 10 described below.

The printer portion 10 has a drum shaped electrophotographic photosensitive member (photosensitive drum) 1 as an image bearing member. The photosensitive drum 1 is supported rotatably in a direction represented by an arrow in the figure. On the periphery of the photosensitive drum 1, a pre-exposure lamp 8, a corona charger 2 serving as charging means, a laser exposure optical system 3 serving as exposure means, a potential sensor 9, a rotary developing apparatus 40, an intermediate transfer unit 20 having an intermediate transferring belt 21 as an intermediate transfer member, a cleaning device 6 serving as cleaning means, and the like are placed.

The rotary developing apparatus 40 includes 5 developing devices 4*t*, 4*y*, 4*m*, 4*c*, and 4*k* filled with toner having different spectral characteristics as developing means in a rotary portion (holding portion) 41 serving as developing device holding means. The configuration of each of the developing devices 4*t*, 4*y*, 4*m*, 4*c*, and 4*k* can be set to be substantially the same as that of Embodiment 1. The configuration of each developing device is the same except for a developer to be used. Therefore, unless particular discrimination is required, the developing devices will be collectively described by omitting subscripts t, y, m, c, and k provided to the reference numerals for discriminating elements of the respective colors.

The toner in the developing device 4 is supplied at any time from supply toner containing portions (hoppers) 42*t*, 42*y*, 42*m*, 42*c*, and 42*k* for the respective colors placed laterally between the digital color image reader portion 60 and the laser exposure optical system 3 in the figure so that the density of toner (ratio of the weight of toner with respect to the entire weight of developers: toner proportion) or the amount of toner in the developing device 4 to be constant.

The intermediate transfer unit 20 includes an intermediate transfer member that is a belt member performing endless movement, i.e., the intermediate transferring belt 21 as an image transport member that directly bears and transports a toner image transferred from the image bearing member. The intermediate transferring belt 21 is wound around four rollers: a drive roller 22, driven rollers 23 and 27, and a secondary transfer counter roller 24 in this embodiment. The intermediate transferring belt 21 turns (rotates) in a direction represented by an arrow E in the figure when a driving force is transmitted to the drive roller 22. On a back surface side of the intermediate transferring belt 21, at a position opposed to the photosensitive drum 1 with the intermediate transferring belt 21 interposed therebetween, a primary transfer roller 5 serving as a primary transfer portion is placed. Further, at a position opposed to the secondary transfer counter roller 24 via the intermediate transferring belt 21, a secondary transfer roller 25 serving as secondary transfer means is placed. As the intermediate transferring belt 21, the belt that is substantially the same as that of Embodiment 1 can be used.

Next, an image forming operation will be described. An image signal from a computer, an image signal from a facsimile machine, and the like, as well as a signal from the digital color image reader portion 60 are similarly sent to the printer portion 10. Herein, the operation of the printer portion will be described as a representative based on a signal from the reader portion.

During image formation, the photosensitive drum 1 rotates in the direction represented by the arrow in the figure. After being diselectrified by the pre-exposure lamp 8, the photosensitive drum 1 is uniformly charged by the corona charger 2. Then, the surface of the charged photosensitive drum 1 is exposed for each separated color, whereby an electrostatic image is formed on the photosensitive drum 1. That is, in the laser exposure optical system 3, the image signal from the digital color image reader portion 60 is converted to a light signal in a laser output portion (not shown). Then, the laser light converted to the light signal is reflected by a polygon mirror and projected onto the surface of the photosensitive drum 1 through a lens and each reflection mirror.

The electrostatic image on the photosensitive drum 1 is successively developed by a predetermined developing device 4. To be more specific, the rotary developing apparatus 40 rotates the rotary portion 41 to move the predetermined developing device 4 to a developing position opposed to the photosensitive drum 1. After that, the developing device 4 is operated, and the electrostatic image on the photosensitive drum 1 is developed as a toner image.

The toner image formed on the photosensitive drum 1 is primarily transferred onto the intermediate transferring belt 21 electrostatically in the primary transfer portion N1, when the primary transfer roller 5 is applied with a bias from a primary transfer bias power supply 90 serving as primary transfer bias application means.

In this embodiment, substantially in the same way as in Embodiment 1, first, a transparent image (toner image of transparent toner) corresponding to a non-image portion of an original image is formed, and thereafter, a colored image corresponding to an image portion of the document image is formed. For example, during formation of a full-color image, first, a transparent toner image corresponding to a non-image portion of an original image, formed in the first order on the photosensitive drum 1 using the developing device 4*t* for transparent toner, is primarily transferred onto the intermediate transferring belt 21. After that, images of respective component colors (yellow, magenta, cyan, and black) of an image portion of the document image, successively formed in the second and subsequent orders on the photosensitive drum 1 using the developing devices 4*y*, 4*m*, 4*c*, and 4*t* for the respective colors: yellow, magenta, cyan, and black, are successively primarily transferred onto the intermediate transferring belt 21 so as to be superimposed. Consequently, a full-color toner image is formed on the intermediate transferring belt 21.

In the same way as in Embodiment 1, a monochrome image of either one of yellow, magenta, cyan, and black or a multicolor image of a combination of some of these colors may be formed. Even in this case, an image of transparent toner can be formed in a non-image portion in the same way as in the above-mentioned formation of the full-color image.

The toner images on the intermediate transferring belt 21 are collectively secondarily transferred onto a recording material S owing to the function of the secondary transfer roller 25 in the secondary transfer portion N2.

The recording material S is transported from recording material supply means 30 to the secondary transfer portion N2. That is, in the recording material supply means 30, the recording material S accommodated in the recording material accommodating portion (cassette) 31 is fed by a pickup roller 32 or the like serving as recording material supply means on a one-by-one basis, and transported to the secondary transfer portion N2 at a desired timing after performing skew feed correction by a resist roller 33.

The recording material S with the toner image transferred thereon in the secondary transfer portion N2 is transported to a heat roller fixing device 9 serving as fixing means through a transporting portion 71. The recording material S is discharged to a delivery tray or a post-processing apparatus (not shown) after the toner image is fixed thereon by the heat roller fixing device 9. In this embodiment, the surface layer of the heat roller fixing device 9 is not made of rubber, and is covered with a fluororesin tube. With such a configuration, the life of the heat roller fixing device 9 is prolonged.

On the other hand, the toner (primary transfer residual toner) remaining on the photosensitive drum 1 after the primary transfer step is collected by the cleaning device 6. Further, at a position opposed to the drive roller 22 with the intermediate transferring belt 21 interposed therebetween, a transfer cleaning device 28 is placed so as to come into contact with the drive roller 22. After images of a required number of colors are superimposed on the intermediate transferring belt 21, the transfer cleaning device 28 is pressed against the drive roller 22 via the intermediate transferring belt 21, and cleans toner (secondary-transfer residual toner) remaining on the intermediate transferring belt 21 after the toner images are secondarily transferred onto the recording material S. Thus, the intermediate transferring belt 21 is subjected to a primary transfer step again.

In this embodiment, at a position opposed to the driven roller 23, a sensor (optical sensor) 26 for detecting the misregistration and image density transferred from the photosensitive drum 1 is placed. Then, the image density, toner supply amount, image writing timing, image writing start position, and the like are corrected at any time.

<Suppression of Toner Scattering and Reduction in the Amount of Re-transfer Toner>

Next, the configuration of the primary transfer portion N1, which is most characteristic in this embodiment, will be described in more detail.

Figure 9:
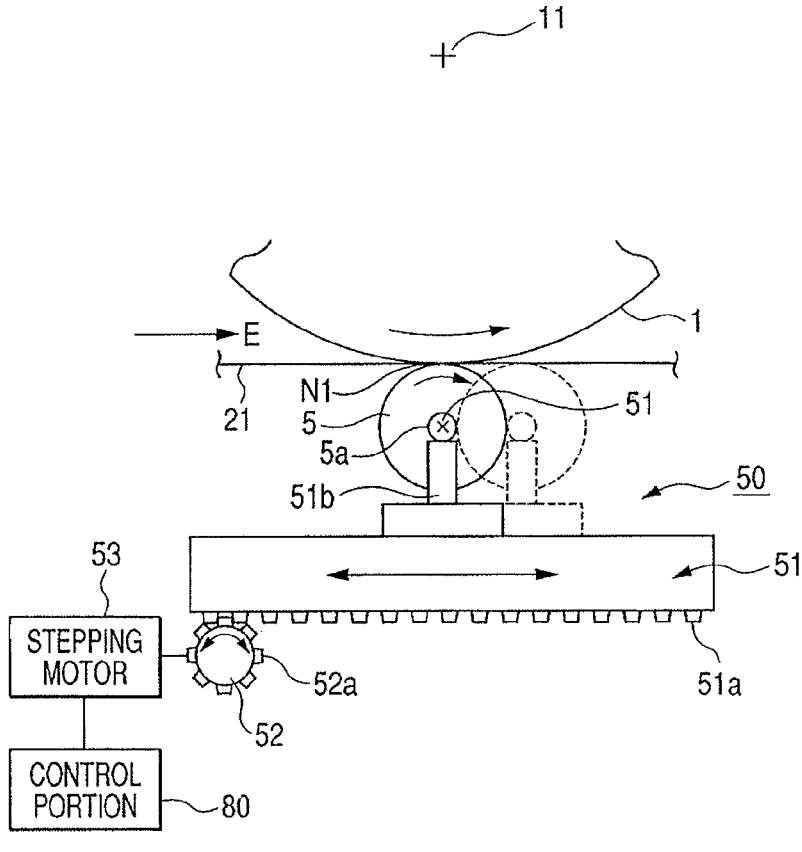
FIG. 9 is a schematic view of an embodiment of a transfer portion applicable to the image forming apparatus of FIG. 8 in accordance with the present invention.

FIG. 9 shows a schematic configuration of the vicinity of the primary transfer portion N1 in the image forming apparatus 200 of this embodiment. In this embodiment, the primary transfer roller 5 is fixed to a support base 51 serving as a support member placed in parallel with the intermediate transferring belt 21. That is, a center shaft 5*a* extending to both ends in a longitudinal direction of the primary transfer roller 5 (primary transfer portion) is supported rotatably by a support portion 51*b* of the support base 51. The support base 51 is connected to a stepping motor 53 serving as a driving source via a gear 52 serving as driving transmission means. That is, teeth 51*a* formed on one end surface of the support base 51 and teeth 52*a* of the gear 52 are engaged, whereby the driving force of the stepping motor 53 is transmitted from the gear 52 to the support base 51. As represented by the arrow in the figure, the support base 52 can reciprocate in the movement direction of the intermediate transferring belt 21. Herein, primary transfer portion moving means for moving the primary transfer roller 5 is composed of the support base 51 and the gear 52.

With such the configuration, in this embodiment, the position of the rotation shaft of the primary transfer roller 5 with respect to the rotation shaft of the photosensitive drum 1 is changed, whereby an offset value W of a center $B_0$ of an area B in the movement direction of the intermediate transferring belt 21 with respect to a center $A_0$ of an area A in the movement direction of the intermediate transferring belt 21 can be changed during image formation.

Driving means 50 for variably controlling the position of the center $B_0$ of the area B with respect to the center $A_0$ of the area A in the movement direction of the intermediate transferring belt 21 is composed of the support base 51, the gear 52, and the stepping motor 53.

Thus, by setting the offset value W to be variable, in the same way as in the case of the tandem-type image forming apparatus 100 of Embodiment 1, the optimum configuration of the primary transfer portion N1 can be obtained for each colored toner in the rotary-type image forming apparatus.

In this embodiment, among toner of a plurality of colors, a toner image of transparent toner is formed on the photosensitive drum 1 first, i.e., in the first order, and primarily transferred onto the intermediate transferring belt 21. After that, i.e., in the second and subsequent orders, toner images of colored toner are successively formed on the photosensitive drum 1, and successively primarily transferred onto the intermediate transferring belt 21. At this time, at least during the primary transfer step of a toner image of transparent toner, the center $B_0$ of the area B in the movement direction of the intermediate transferring belt 21 is offset to a downstream side in the movement direction of the intermediate transferring belt 21 relatively with respect to the center $A_0$ of the area A in the movement direction of the intermediate transferring belt 21.

In this embodiment, a center line X of the photosensitive drum 1 is substantially matched with the center $A_0$ of the area A, and a center line Y of the transfer roller is substantially matched with the center $B_0$ of the area B. Thus, in this embodiment, at least during the primary transfer step of a toner image of transparent toner, the driving means 50 moves the rotation shaft of the primary transfer roller 5 to a downstream side in the movement direction of the intermediate transferring belt 21 with respect to the rotation shaft of the photosensitive drum 1.

On the other hand, during the primary transfer step of toner images of colored toner, the offset value W of the center $B_0$ of the area B with respect to the center $A_0$ of the area A is set to be smaller than that during the primary transfer step of a toner image of transparent toner. Preferably, during the primary transfer step of a toner image of each colored toner, the offset value W is set to be 0 mm, whereby the center $A_0$ of the area A in the movement direction of the intermediate transferring belt 21 is matched with the center $B_0$ of the area B.

That is, the position in the rotation direction of the photosensitive drum 1 of the primary transfer roller 5 when the transparent toner is transferred is on a downstream side of the position in the rotation direction of the photosensitive drum 1 of the primary transfer roller 5 when a colored toner image is transferred. That is, the position of the primary transfer roller 5 with respect to the developing device 4*t* in the rotation direction of the photosensitive drum 1 when a transparent toner image is transferred is on a downstream side of the position of the primary transfer roller 5 with respect to the developing devices 4*y*, 4*m*, or 4*c* in the rotation direction of the photosensitive drum 1 when a colored toner image is transferred.

In this embodiment, the operation of the stepping motor 53 controls a controller portion 80 that collectively controls the operation of the image forming apparatus 200. The controller portion 80 has a storage portion, a control portion, and a calculation portion, and controls, in accordance with a program stored in the storage portion, the stepping motor 53 so as to change the position of the primary transfer roller 5 to an optimum position for toner of each color at least before a toner image of toner of each color reaches the primary transfer portion N1 during the image formation operation.

To be more specific, in this embodiment, in the same way as in Embodiment 1, the offset value W during the primary transfer step of a toner image of transparent toner was set to be 5 mm, and the offset value W during the primary transfer step of toner images of yellow, magenta, cyan, and black toner was set to be 0 mm. Because of this, the occurrence of the toner scattering and the amount of re-transfer toner were able to be reduced. In this embodiment, the width of the area A was also set to be 2 mm. Thus, L1 during the primary transfer step of a toner image of transparent toner is 6 mm. Further, L1 during the primary transfer step of toner images of yellow, magenta, cyan, and black toner is 1 mm.

Figure 10:
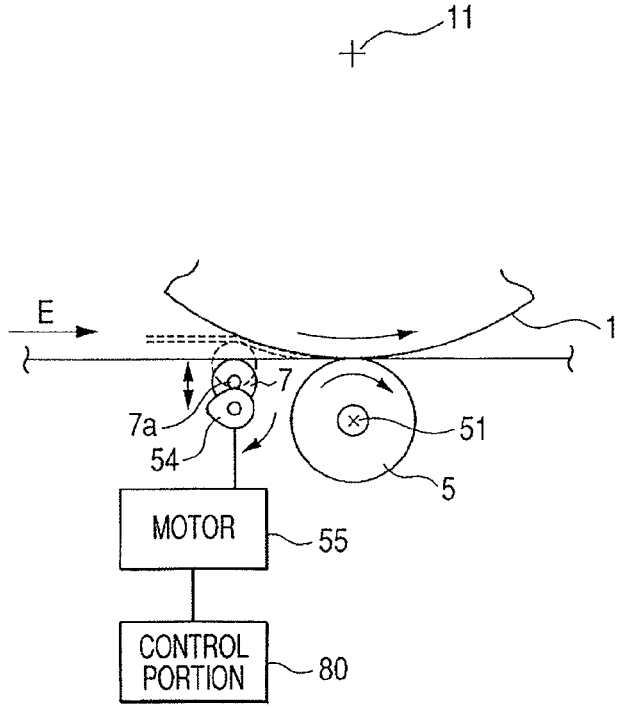
FIG. 10 is a schematic view of another embodiment of a transfer portion applicable to the image forming apparatus of FIG. 8 in accordance with the present invention.

In the foregoing description, the primary transfer roller 5 is moved with respect to the photosensitive drum 1. However, in the same way as in Embodiment 2, a biasing member for biasing the intermediate transferring belt 21 toward the photosensitive drum 1 may be provided on an upstream side in the movement direction of the intermediate transferring belt 21 with respect to the primary transfer roller 5, whereby the offset value W of the center $B_0$ of the area B with respect to the center $A_0$ of the area A in the movement direction of the intermediate transferring belt 21 is changed. That is, for example, as shown in FIG. 10, a lift roller 7 similar to that in Embodiment 2 is provided as a biasing member so that a center shaft 7*a* at both ends in the longitudinal direction of the lift roller 7 may be lifted up toward the intermediate transferring belt 21 with a cam 54 or the like serving as drive transmitting means connected to a motor 55 serving as a driving source, or that the lift-up may be removed. Because of this, the motor 55 is rotated at a desired timing, the lift roller 7 is biased toward the photosensitive drum 1 with the cam 54, and the center $B_0$ of the area B is offset to a downstream side with respect to the center $A_0$ of the area A in the movement direction of the intermediate transferring belt 21, whereby the upstream side gap nip C that causes toner scattering can be eliminated. In this case, the driving means 50 for variably controlling the position of the center $B_0$ of the area B with respect to the center $A_0$ of the area A in the movement direction of the intermediate transferring belt 21 is composed of the cam 54, the motor 55, and the like.

Further, the primary transfer roller 5 may be on an upstream side in the movement direction of the intermediate transferring belt 21 during the primary transfer of a colored toner image. Because of this, the position in the rotation direction of the photosensitive drum 1 of the primary transfer roller 5 when transparent toner image is transferred can be set to be on a downstream side with respect to the position in the rotation direction of the photosensitive drum 1 of the primary transfer roller 5 when a colored toner image is transferred. Even with such a configuration, the effect similar to that mentioned above can be obtained. For example, regarding the primary transfer roller 5 during the primary transfer of a colored toner image, the offset value W is set to be 5 mm on an upstream side in the movement direction of the intermediate transferring belt 21. Further, regarding the primary transfer roller 5 during the primary transfer step of a transparent toner image, the offset value W is set to be 0 mm. In this embodiment, the width of the area A was set to be 2 mm. Thus, L1 during the primary transfer step of a toner image of transparent toner is 6 mm. Further, L1 during the primary transfer step of a toner image of yellow, magenta, cyan, and black toner is 1 mm.

(Other)

The present invention has been described by way of specific embodiments. However, the present invention is not limited to the embodiments of the above-mentioned respective embodiments.

For example, in each of the foregoing embodiments, the image forming apparatus adopts an intermediate transfer system. However, the present invention is not limited thereto, and the present invention is also applicable equally to an image forming apparatus of a direct transfer system known to those skilled in the art.

Figure 11:
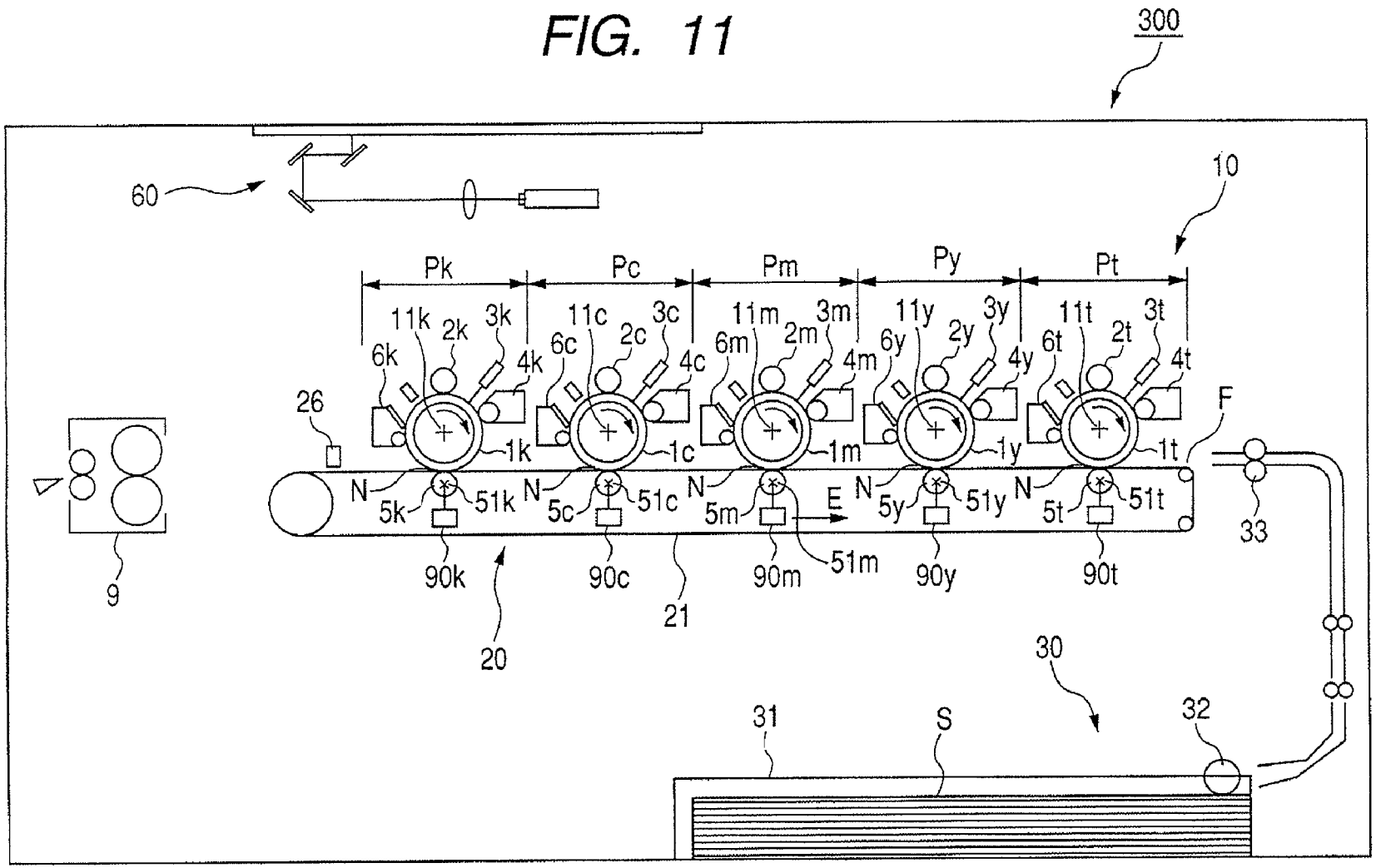
FIG. 11 is a schematic cross-sectional structural view of another embodiment of an image forming apparatus to which the present invention is applicable.

For example, FIG. 11 shows a schematic cross-sectional configuration of a tandem-type image forming apparatus 300 that adopts a direct transfer system. In the image forming apparatus 300 in FIG. 11, the elements having the functions and configurations that are substantially the same as or similar to those in the image forming apparatus 100 shown in FIG. 1 are denoted with the same reference numerals as those therein, and the detailed description thereof will be omitted. The image forming apparatus 300 in FIG. 11 includes a transfer unit in place of the intermediate transfer unit 20 in the image forming apparatus 100 in FIG. 1. To be more specific, the transfer unit 20 includes a recording material bearing member, i.e., a conveyor belt (recording material bearing belt) 21 that is a belt member performing endless movement as an image transport member that bears and transports a toner image transferred from the image bearing member via a recording material. The surface of the conveyor belt 21 comes into contact with the photosensitive drum 1 of each image forming portion P to form a transfer portion N. Further, on the back surface of the conveyor belt, the transfer roller 5 serving as a transfer member is provided to come into contact with the conveyor belt 21 so as to correspond to the photosensitive drum 1 of each image forming portion P.

Recording material supply means 30 supplies a recording material to a recording material supply portion F of the conveyor belt 21. Then, in the transfer portion N, each image forming portion P successively transfers a toner image to a recording material S borne on the conveyor belt 21 from the photosensitive drum 1 to form a toner image. The conveyor belt 21 having passed through the recording material supply portion F passes through the transfer portion N of the transparent toner image forming portion Pt, and then passes through the transfer portion N of the colored toner image forming portions Py, Pm, Pc, and Pk. The recording material S with the toner image transferred thereon is separated from the conveyor belt 21, and transported to a heat roller fixing device 9, whereby the toner image is fixed.

With such the image forming apparatus 300, an image forming portion on a most upstream side in the movement direction of the conveyor belt 21 is set to be a transparent toner image forming portion for forming a toner image of transparent toner, and the configuration of the transfer portion N of each image forming portion P can be set to be substantially the same as that of the primary transfer portion of the image forming apparatus 100 of Embodiments 1 and 2. Because of this, the same functional effect as that described in each of Embodiments 1 and 2 can be obtained.

Figure 12:
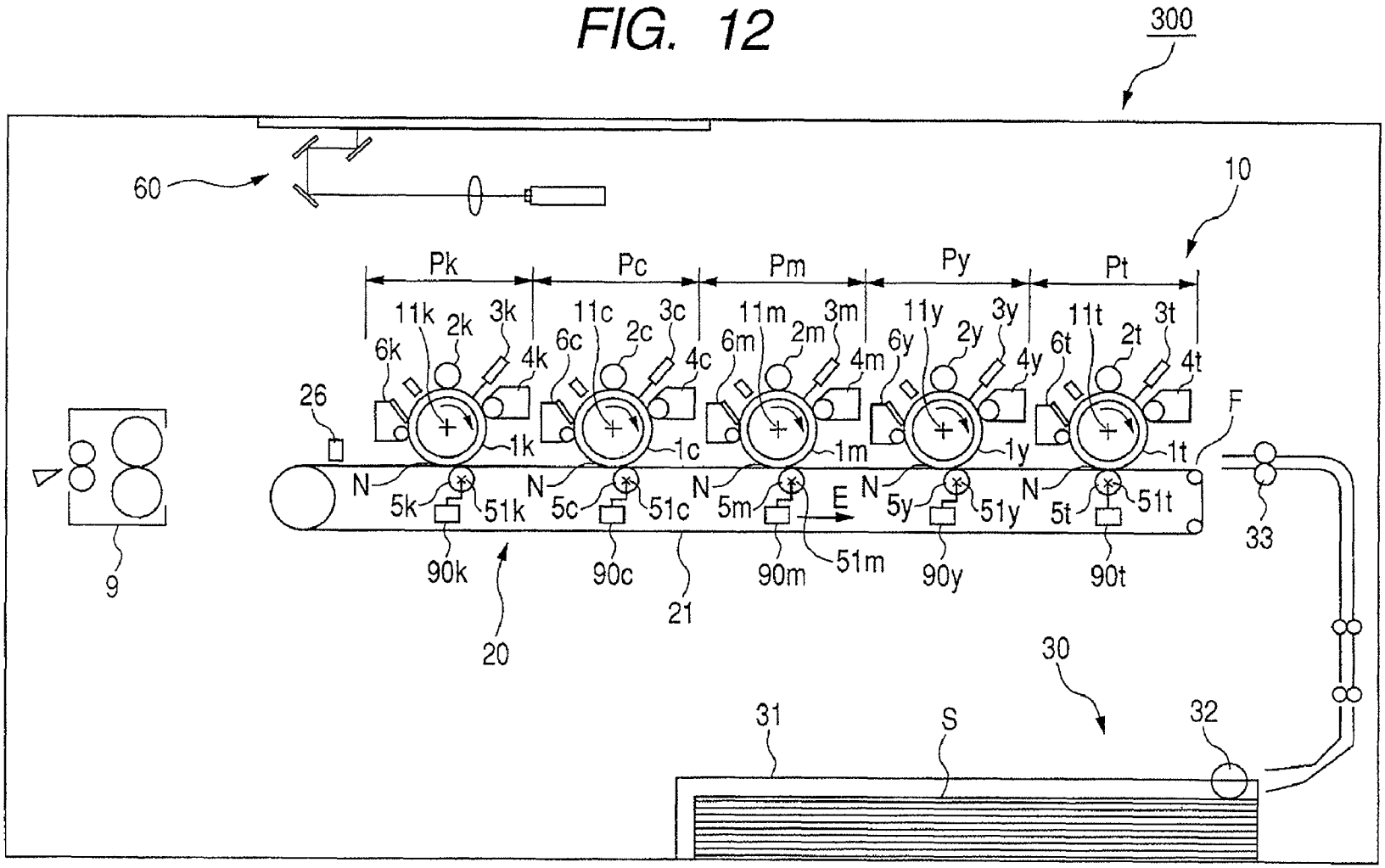
FIG. 12 is a schematic cross-sectional structural view of still another embodiment of an image forming apparatus according to the present invention.

As shown in FIG. 12, even in the image forming apparatus of a direct transfer system, the primary transfer roller 5 of the colored toner image forming portions Py, Pm, Pc, and Pk may be on an upstream side in the movement direction of the conveyor belt 21. Because of this, in the same way as in the foregoing discussion, the position in the rotation direction of the photosensitive drum 1*t* of the primary transfer roller 5*t* of the transparent toner image forming portion Pt can be set to be on a downstream side with respect to the positions in the rotation direction of the photosensitive drums 1*y*, 1*m*, 1*c*, and 1*k* of the primary transfer rollers 5*y*, 5*m*, 5*c*, and 5*k* of the colored toner image forming portions Py, Pm, Pc, and Pk. With such the configuration, the same effect as that described above can be obtained. For example, regarding the primary transfer roller 5 of the colored toner image forming portions Py, Pm, Pc, and Pk, the offset value W is set to be 5 mm on an upstream side in the movement direction of the conveyor belt 21. Further, regarding the primary transfer roller 5 of the transparent toner image forming portion Pt, the offset value W is set to be 0 mm. Even in this embodiment, the width of the area A was set to be 2 mm. Thus, L1 during the primary transfer step of a toner image of transparent toner is 6 mm. Further, L1 during the primary transfer step of toner images of yellow, magenta, cyan, and black toner is 1 mm.

Further, similarly, there is a rotary-type image forming apparatus that has a transfer unit with a conveyor belt similar to that described above, in place of the intermediate transfer unit 20 in the rotary-type image forming apparatus 200 adopting an intermediate transfer system shown in FIG. 8. In this rotary-type image forming apparatus, there is adopted a direct transfer system for transferring toner images to a recording material on a conveyor belt, in which the toner images are successively superimposed, by bearing a recording material on a conveyor belt and repeatedly allowing the recording material to pass through the transfer portion N. Even with such an image forming apparatus, a toner image of transparent toner can be transferred onto a recording material on a conveyor belt first, and the configuration of the transfer portion N can be set to be substantially the same as that of the transfer portion N of the image forming apparatus 200 of Embodiment 3. Because of this, the same functional effect as that described in Embodiment 3 can be obtained.

Further, in the above-described embodiment, the image forming apparatus having a plurality of developing devices with respect to one image bearing member is a rotary-type image forming apparatus with a plurality of developing devices in a rotary portion serving as a rotary member. However, the present invention is not limited thereto. For example, there is an image forming apparatus in which a plurality of developing devices are placed adjacent to each other around one image bearing member, a developing operation is performed, for example, by moving a desired developing device to a position closer to the image bearing member at a desired timing, and toner images of a plurality of kinds of toners are successively formed on a recording material on the intermediate transfer member or the recording material bearing member via one image bearing member. Even with such the image forming apparatus, the present invention is equally applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-222282, filed Jul. 29, 2005, which is hereby incorporated by reference herein in its entirety.

What is claimed is:

1. An image forming apparatus, comprising:

a recording material bearing member that bears and conveys a recording material, and that is movable;

a first image bearing member that comes into contact with the recording material bearing member, and that bears a color toner image;

a first transfer member that electrostatically transfers the color toner image formed on the first image bearing member to a recording material on the recording material bearing member;

a second image bearing member, provided on an upstream side from the first image bearing member in a rotation direction of the recording material bearing member, that comes into contact with the recording material bearing member, and that bears a transparent toner image; and a second transfer member that electrostatically transfers the transparent toner image formed on the second image bearing member to the recording material on the recording material bearing member, wherein a second transfer position, where the second transfer member comes into contact with the recording material bearing member, is farther downstream in the rotation direction of the recording material bearing member relative to a center of the second image bearing member than a first transfer position, where the first transfer member comes into contact with the recording material bearing member, in the rotation direction of the recording material bearing member relative to a center of the first image bearing member.

2. An image forming apparatus according to claim 1, wherein a center of the second transfer member is on a downstream side in the rotation direction of the recording material bearing member from the center of the second image bearing member.

3. An image forming apparatus according to claim 1, wherein a distance between a vertical line from a center of the second transfer member to the recording material bearing member and a vertical line from the center of the second image bearing member to the recording material bearing member is longer than a distance between a vertical line from a center of the first transfer member to the recording material bearing member and a vertical line from the center of the first image bearing member to the recording material bearing member.

4. An image forming apparatus according to claim 1, wherein a distance in the rotation direction of the recording material bearing member between an upstream end of a first contact area, where the first image bearing member comes into contact with the recording material bearing member, and a downstream end of the first contact area is shorter than a distance in the rotation direction of the recording material bearing member between an upstream end of a second contact area, where the second image bearing member comes into contact with the recording material bearing member, and a downstream end of the second contact area.

5. An image forming apparatus according to claim 1, wherein a distance in the rotation direction of the recording material bearing member between an upstream end of a first contact area, where the first image bearing member comes into contact with the recording material bearing member, and a vertical line from a center of the first transfer member to the recording material bearing member is shorter than a distance in the rotation direction of the recording material bearing member between an upstream end of a second contact area, where the second image bearing member comes into contact with the recording material bearing member, and a vertical line from a center of the second transfer member to the recording material bearing member.

6. An image forming apparatus according to claim 1, further comprising:

a plurality of first image bearing members that bear color toner images, and that come into contact with the recording material bearing member; and a plurality of first transfer members that respectively press each of the plurality of first image bearing members for electrostatically transferring the color toner images formed on the plurality of first image bearing members to the recording material on the recording material bearing member, wherein the position, where the second transfer member comes into contact with the recording material bearing member is on a farthest downstream side in the rotation direction of the recording material bearing member relative to the center of the second image bearing member from positions, where the plurality of first transfer members come into contact with the recording material bearing member, in the rotation direction of the recording material bearing member relative to centers of the plurality of first image bearing members, respectively.

7. An image forming apparatus, comprising:

a recording material bearing member that bears and conveys a recording material, and that is movable;

a first image bearing member that comes into contact with the a recording material bearing member that bears and conveys a recording material, and that bears a color toner image;

a first transfer member that electrostatically transfers the color toner image formed on the first image bearing member to a recording material on the recording material bearing member;

a second image bearing member, provided on an upstream side from the first image bearing member in a rotation direction of the recording material bearing member, that comes into contact with the recording material bearing member and, that bears a transparent toner image; and a second transfer member that electrostatically transfers the transparent toner image formed on the second image bearing member to the recording material on the recording material bearing member, wherein a distance in the rotation direction of the recording material bearing member between an upstream end of a first contact area, where the first image bearing member comes into contact with the recording material bearing member, and a vertical line from a center of the first transfer member to the recording material bearing member is shorter than a distance in the rotation direction of the recording material bearing member between an upstream end of a second contact area, where the second image bearing member comes into contact with the recording material bearing member and a vertical line from a center of the second transfer member to the recording material bearing member.

8. An image forming apparatus according to claim 7, further comprising:

a lift member that lifts the recording material bearing member to cause the recording material bearing member to come into contact with the second image bearing member on an upstream side from the second transfer member in the rotation direction of the recording material bearing member.

9. An image forming apparatus according to claim 7, wherein a second transfer position, where the second transfer member comes into contact with the recording material bearing member, is farther downstream in the rotation direction of the recording material bearing member relative to a center of the second image bearing member than a first transfer position, where the first transfer member comes into contact with the recording material bearing member, in the rotation direction of the recording material bearing member relative to a center of the first image bearing member.

10. An image forming apparatus according to claim 7, wherein the center of the second transfer member is on a downstream side in the rotation direction of the recording material bearing member from a center of the second image bearing member.

11. An image forming apparatus according to claim 7, wherein a distance between a vertical line from the center of the second transfer member to the recording material bearing member and a vertical line from a center of the second image bearing member to the recording material bearing member is longer than a distance between a vertical line from the center of the first transfer member to the recording material bearing member and a vertical line from a center of the first image bearing member to the recording material bearing member.

12. An image forming apparatus according to claim 7, further comprising:

a plurality of color image bearing members including the first image bearing member, that bear color toner images, and that come into contact with the recording material bearing member; and a plurality of color transfer members, including the first transfer member, that respectively press each of the plurality of color image bearing members for electrostatically transferring the color toner images formed on the plurality of color image bearing members to the recording material on the recording material bearing member, wherein a second transfer position, where the second transfer member comes into contact with the recording material bearing member is farther downstream in the rotation direction of the recording material bearing member relative to a center of the second image bearing member than a plurality of color transfer positions, where each of the plurality of color transfer members come into contact with the recording material bearing member, in the rotation direction of the recording material bearing member relative to centers of each of the plurality of color transfer members, respectively.

* * * * *